US011705065B2

(12) United States Patent
Lee

(10) Patent No.: US 11,705,065 B2
(45) **Date of Patent: *Jul. 18, 2023**

(54) DISPLAY DEVICE AND DISPLAY PANEL

(71) Applicant: LG DISPLAY CO., LTD., Seoul (KR)

(72) Inventor: HyunHaeng Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/546,574

(22) Filed: Dec. 9, 2021

(65) Prior Publication Data

US 2022/0208097 A1 Jun. 30, 2022

(30) Foreign Application Priority Data

Dec. 30, 2020 (KR) ..... 10-2020-0186990

(51) Int. Cl.
*G09G 3/3233* (2016.01)
*G09G 3/20* (2006.01)

(52) U.S. Cl.
CPC ..... *G09G 3/3233* (2013.01); *G09G 3/2003* (2013.01); *G09G 2300/0443* (2013.01); *G09G 2300/0452* (2013.01); *G09G 2300/0465* (2013.01); *G09G 2300/0842* (2013.01); *G09G 2310/08* (2013.01); *G09G 2320/0242* (2013.01)

(58) Field of Classification Search
CPC ..... G09G 3/3233; G09G 3/2003; G09G 2300/0443; G09G 2300/0452; G09G 2300/0465; G09G 2300/0842; G09G 2310/08; G09G 2320/0242; G09G 2300/0426; G09G 2320/0295; G09G 3/2074; G09G 3/3225; G09G 3/3266; G09G 3/3275; G09G 2320/0233
See application file for complete search history.

(56) References Cited

U.S. PATENT DOCUMENTS

2013/0168655 A1* 7/2013 Yun ..... H01L 27/3216 438/34
2014/0105289 A1* 4/2014 Su ..... H04N 19/105 375/240.12
2016/0055803 A1* 2/2016 Kim ..... G09G 3/3233 345/691
2016/0351115 A1* 12/2016 Bang ..... G09G 3/2003
2017/0024006 A1* 1/2017 Kwon ..... G06T 7/13
2018/0174533 A1* 6/2018 An ..... G09G 3/3607
2020/0372870 A1* 11/2020 Chen ..... G09G 3/3688

* cited by examiner

*Primary Examiner* — Antonio Xavier
(74) *Attorney, Agent, or Firm* — Morgan, Lewis & Bockius LLP

(57) ABSTRACT

In a display device and display panel, a display panel includes: a plurality of pixels arranged in a matrix, each including two white subpixels and a plurality of colored subpixels, and a data pad connecting two adjacent colored subpixels, among the plurality of colored subpixels, corresponding to a same color, in a first direction, wherein luminance data is applied to the white subpixel, wherein each of the plurality of colored subpixels includes a dual subpixel having a size of the two white subpixels arranged in a second direction, the dual subpixel including a plurality of transistors, wherein a first transistor in the dual subpixel is connected to a first signal line extending through a first of the two white subpixels, and wherein a second transistor in the dual subpixel, is connected to a second signal line extending through a second of the two white subpixels.

20 Claims, 14 Drawing Sheets

| | | | | |
|---|---|---|---|---|
| Image Source | $Y_{11}\ Cb_{11}\ Cr_{11}$ | $Y_{12}\ Cb_{11}\ Cr_{11}$ | $Y_{13}\ Cb_{13}\ Cr_{13}$ | $Y_{14}\ Cb_{13}\ Cr_{13}$ |
| | $Y_{21}\ Cb_{11}\ Cr_{11}$ | $Y_{22}\ Cb_{11}\ Cr_{11}$ | $Y_{23}\ Cb_{13}\ Cr_{13}$ | $Y_{24}\ Cb_{13}\ Cr_{13}$ |

| | | | | |
|---|---|---|---|---|
| RGB Image Data | $R_{11}\ G_{11}\ B_{11}$ | $R_{12}\ G_{12}\ B_{12}$ | $R_{13}\ G_{13}\ B_{13}$ | $R_{14}\ G_{14}\ B_{14}$ |
| | $R_{21}\ G_{21}\ B_{21}$ | $R_{22}\ G_{22}\ B_{22}$ | $R_{23}\ G_{23}\ B_{23}$ | $R_{24}\ G_{24}\ B_{24}$ |

| | | | | |
|---|---|---|---|---|
| WRGB Image Data | $W_{11}\ R_{11}\ G_{11}\ B_{11}$ | $W_{12}\ R_{11}\ G_{11}\ B_{11}$ | $W_{13}\ R_{13}\ G_{13}\ B_{13}$ | $W_{14}\ R_{13}\ G_{13}\ B_{13}$ |
| | $W_{21}\ R_{11}\ G_{11}\ B_{11}$ | $W_{22}\ R_{11}\ G_{11}\ B_{11}$ | $W_{23}\ R_{13}\ G_{13}\ B_{13}$ | $W_{24}\ R_{13}\ G_{13}\ B_{13}$ |

DISPLAY DEVICE AND DISPLAY PANEL

CROSS-REFERENCE TO RELATED APPLICATION(S)

This application claims the benefit of and priority to Korean Patent Application No. 10-2020-0186990, filed on Dec. 30, 2020, the entirety of which is hereby incorporated by reference.

BACKGROUND

1. Technical Field

The present disclosure relates to a display device and a display panel.

2. Discussion of the Related Art

As the information society develops, the demand for display devices for displaying images is increasing in various forms. Various types of display devices, such as a liquid crystal display (LCD) device, a plasma display panel (PDP), and an organic light-emitting display (OLED) device, have been used for this purpose.

The image data input to the display device may be RGB image data, including red data (R), green data (G), and blue data (B), or may be YCbCr image data, including luminance data (Y) and color difference data (Cb, Cr). For example, the Cb data represents the difference (Y−B) between the luminance data (Y) and the blue data (B), and the Cr data represents the difference (Y−R) between the luminance data (Y) and the red data (R). The image data may also include white data (W). When the display device includes WRGB subpixels, including white subpixels, red subpixels, green subpixels, and blue subpixels, the display device converts input RGB image data or YCbCr image data into WRGB format, and displays an image.

For example, while RGB image data supports a 4:4:4 format in which all color components have the same sampling ratio, the YCbCr image data supports formats such as 4:4:4, 4:2:2, and 4:2:0 depending on the sampling ratio of the color difference component. For example, YCbCr image data used for TV broadcasts, sports broadcasts, movies, etc. Are formed in a 4:2:0 format, YCbCr image data used in games are formed in various formats of 4:4:4, 4:2:2, and 4:2:0, and YCbCr image data used in a computer may be formed in a 4:4:4 format. Accordingly, a display device having a WRGB pixel structure, particularly a WRGB display device, needs to convert and display the received YCbCr image data according to the WRGB pixel structure.

SUMMARY

Accordingly, the present disclosure is directed to a display device and a display panel that substantially obviate one or more of the issues due to limitations and disadvantages of the related art.

Embodiments of the present disclosure may provide a display device and a display panel capable of displaying YCbCr image data as WRGB image data. In addition, embodiments of the present disclosure may provide a display device a display panel capable of displaying YCbCr image data as WRGB image data while simplifying the structure of a driving circuit.

In addition, embodiments of the present disclosure may provide a display device and a display panel capable of displaying YCbCr image data as WRGB image data by changing the structure of the display panel. In addition, embodiments of the present disclosure may provide a display device and a display panel capable of improving the aperture ratio by effectively arranging circuit elements and signal lines when displaying YCbCr image data as WRGB image data.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, there is provided a display device, including: a display panel including: plurality of gate lines extending in a first direction, a plurality of data lines extending in a second direction different from the first direction, a plurality of pixels, including two white subpixels and a plurality of colored subpixels, arranged in a matrix form, the two white subpixels and the plurality of colored subpixels being in a region where the plurality of gate lines extending and the plurality of data lines intersect, a gate driving circuit configured to drive the plurality of gate lines, a data driving circuit configured to drive the plurality of data lines, and a timing controller configured to control the gate driving circuit and the data driving circuit, wherein luminance data is applied to each of the two white subpixels, wherein the plurality of colored subpixels includes a first dual subpixel and a second dual subpixel, each having a size corresponding to a size of the two white subpixels arranged in the second direction, each dual subpixel including a plurality of transistors, wherein the first dual subpixel and the second dual subpixel, arranged in the first direction, are connected by one data line, wherein a first transistor, among the plurality of transistors in the first dual subpixel, is connected to a first signal line extending through a first of the two white subpixels, and wherein a second transistor, among the plurality of transistors in the first dual subpixel, is connected to a second signal line extending through a second of the two white subpixels.

In another aspect, there is provided a display panel, including: a plurality of pixels, each including two white subpixels and a plurality of colored subpixels, the plurality of pixels being arranged in a matrix form, and a data pad connecting two adjacent colored subpixels, among the plurality of colored subpixels, corresponding to a same color, in a first direction, wherein luminance data is applied to the white subpixel, wherein each of the plurality of colored subpixels includes a dual subpixel having a size corresponding to a size of the two white subpixels arranged in a second direction different from the first direction, the dual subpixel including a plurality of transistors, wherein a first transistor, among the plurality of transistors in the dual subpixel, is connected to a first signal line extending through a first of the two white subpixels, and wherein a second transistor, among the plurality of transistors in the dual subpixel, is connected to a second signal line extending through a second of the two white subpixels.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages may be discussed below in conjunction with embodiments of the disclosure. It is to be understood that both the foregoing general description and the following detailed description of the present disclosure may be examples and explanatory, and may be intended to provide further explanation of the disclosure as claimed.

BRIEF DESCRIPTION OF THE DRAWINGS

The accompanying drawings, that may be included to provide a further understanding of the disclosure and may be incorporated in and constitute a part of this disclosure, illustrate embodiments of the disclosure and together with the description serve to explain various principles of the disclosure.

Figure 1:
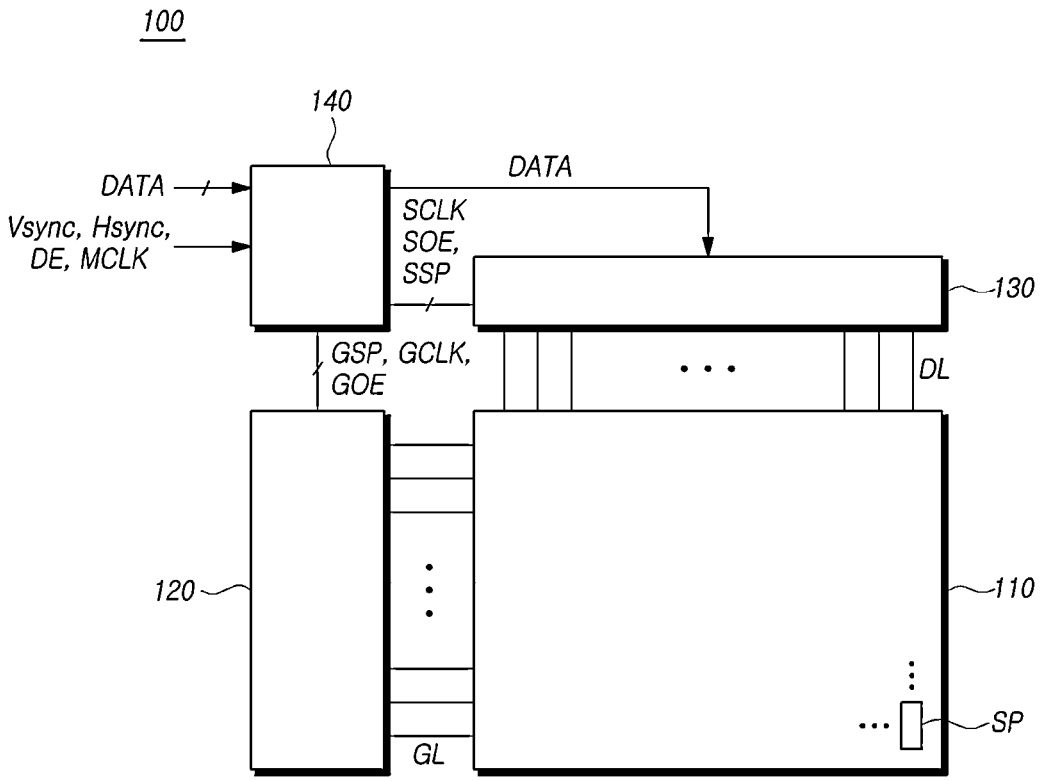
FIG. 1 illustrates a schematic configuration of a display device according to embodiments of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations may be selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments may be provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure may be merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. When terms "include," "have," and "include" described in the present disclosure may be used, another part may be added unless a more limiting term, such as "only," is used. The terms of a singular form may include plural forms unless referred to the contrary.

In construing an element, the element is construed as including an error or tolerance range even where no explicit description of such an error or tolerance range. In describing a position relationship, when a position relation between two parts is described as, for example, "on," "over," "under," or "next," one or more other parts may be disposed between the two parts unless a more limiting term, such as "just" or "direct(ly)," is used. In describing a time relationship, when the temporal order is described as, for example, "after," "subsequent," "next," or "before," a case that is not continuous may be included, unless a more limiting term, such as "just," "immediate(ly)," or "direct(ly)," is used.

It will be understood that, although the terms "first," "second," etc. May be used herein to describe various elements, these elements should not be limited by these terms. These terms may be only used to distinguish one element from another. For example, a first element could be termed a second element, and, similarly, a second element could be termed a first element, without departing from the scope of the present disclosure.

In describing elements of the present disclosure, the terms like "first," "second," "A," "B," "(a)," and "(b)" may be used. These terms may be merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers "disposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings may be given merely for the convenience of description, and embodiments of the present disclosure may not be limited thereto.

In addition, when any dimensions, relative sizes etc. Are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can."

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning for example consistent with their meaning in the context of the relevant art and should not be interpreted in an idealized or overly formal sense unless expressly so defined herein. For example, the term "part" or "unit" may apply, for example, to a separate circuit or structure, an integrated circuit, a computational block of a circuit device, or any structure configured to perform a described function as should be understood to one of ordinary skill in the art.

Hereinafter, example embodiments of the present disclosure will be described in detail with reference to the accompanying drawings.

FIG. 1 illustrates a schematic configuration of a display device according to embodiments of the present disclosure.

With reference to the example of FIG. 1, a display device 100, according to embodiments of the present disclosure, may include a display panel 110 in which a plurality of gate lines GL and data lines DL may be connected, and a plurality of subpixels SP may be arranged in a matrix form, a gate driving circuit 120 driving a plurality of gate lines GL, a data driving circuit 130 for supplying a data voltage through a plurality of data lines DL, and a timing controller 140 that controls the gate driving circuit 120 and the data driving circuit 130. The display panel 110 may display the image based on a scan signal transmitted from the gate driving circuit 120 through a plurality of gate lines GL and a data voltage transmitted from the data driving circuit 130 through a plurality of data lines DL.

In the case of a liquid crystal display (LCD), the display panel 110 may include a liquid crystal layer formed between two substrates, and may be operated in any known mode, such as twisted nematic (TN) mode, vertical alignment (VA) mode, in-plane switching (IPS) mode, fringe field switching (FFS) mode. On the other hand, in the case of an organic light-emitting display, the display panel 110 may be implemented in a top-emission method, a bottom-emission method, or a dual-emission method.

In the display panel 110, a plurality of pixels may be arranged in a matrix form, and each pixel may composed of a plurality of subpixels SP having different colors, for example, a white subpixel, a red subpixel, a green subpixel, and a blue subpixel. Each subpixel SP may be defined by a plurality of data lines DL and a plurality of gate lines GL.

One subpixel SP may include a thin-film transistor (TFT) formed in a region where one data line DL and one gate line GL intersect, a light-emitting element, such as organic light-emitting diode, for charging the data voltage, and a storage capacitor for maintaining a voltage by being electrically connected to the light-emitting element.

For example, when the WRGB display device 100, having a resolution of 2,160×3,840, the 2,160 gate lines GL and all 3,840×4=15,360 data lines DL, is provided by 3,840 data lines DL respectively connected to the four subpixels WRGB. Subpixels SP may be disposed at points where these gate lines GL and data lines DL intersect with each other. The gate driving circuit 120 may be controlled by the timing controller 140, and may sequentially output scan signals to a plurality of gate lines GL disposed on the display panel 110, to control driving timing for a plurality of subpixels SP.

In the display device 100 having a resolution of 2,160×3,840, a case in which scan signals are sequentially output from the first gate line to the 2,160 gate lines for 2,160 gate lines GL may be referred to as "2,160 phase driving." Alternatively, a case in which scan signals are sequentially outputted in units of four gate lines GL, such as when sequentially outputting scan signals from the first gate line to the fourth gate line, and then sequentially outputting the scan signals from the fifth gate line to the eighth gate line, may be referred to as "4-phase driving." That is, a case in which scan signals are sequentially output for every N gate lines GL may be referred to as "N-phase driving."

For example, the gate driving circuit 120 may include one or more gate driving integrated circuits (GDIC), and may be located on only one side or both sides of the display panel 110 according to a driving method. Alternatively, the gate driving circuit 120 may be embedded in a bezel area of the display panel 110, and may be implemented in a GIP (Gate-in-panel) form.

The data driving circuit 130 may receive digital image data DATA from the timing controller 140, and may convert the digital image data into an analog data voltage. The data driving circuit 130 may then output the data voltage to each data line DL, according to the timing at which the scan signal may be applied through the gate line GL, so that each subpixel SP connected to the data line DL may display a light emission signal of brightness corresponding to the data voltage.

Similarly, the data driving circuit 130 may include one or more source driving integrated circuits (SDIC). The source driving integrated circuit SDIC may be connected to a bonding pad of the display panel 110 in a TAB (tape-automated bonding) method or a COG (chip-on-glass) method, or may be directly disposed on the display panel 110.

In some cases, each source driving integrated circuit (SDIC) may be integrated and disposed on the display panel 110. In addition, each source driving integrated circuit (SDIC) may be implemented in a COF (chip-on-film) method. For example, each source driving integrated circuit (SDIC) may be mounted on a circuit film, and may be electrically connected to the data line DL of the display panel 110.

The timing controller 140 may supply various control signals to the gate driving circuit 120 and the data driving circuit 130, and may control operations of the gate driving circuit 120 and the data driving circuit 130. That is, the timing controller 140 may control the gate driving circuit 120 to output the scan signal according to the timing implemented in each frame, and may transfer the digital image data DATA received from the outside to the data driving circuit 130.

For example, the timing controller 140 may receive various timing signals, including a vertical synchronization signal Vsync, a horizontal synchronization signal Hsync, a data enable signal DE, and a main clock signal MCLK, together with digital image data DATA from an external (e.g., host system). Accordingly, the timing controller 140 may generate a control signal using various timing signals received from the outside, and may transmit the control signal to the gate driving circuit 120 and the data driving circuit 130.

For example, to control the gate driving circuit 120, the timing controller 140 may output a plurality of gate control signal, including a gate start pulse signal GSP, a gate clock GCLK, and a gate output enable signal GOE. For example, the gate start pulse signal GSP may control the timing at which one or more gate driving integrated circuits GDIC, constituting the gate driving circuit 120, start to operate. In addition, the gate clock GCLK may be a clock signal commonly input to one or more gate driving integrated circuits GDIC, and may control shift timing of the scan signal. In addition, the gate output enable signal GOE may designate timing information of one or more gate driving integrated circuits GDIC.

In addition, to control the data driving circuit 130, the timing controller may output a plurality of data control signals, including a source start pulse SSP, a source sampling clock SCLK, and a source output enable signal SOE. For example the source start pulse SSP may control the timing at which one or more source driving integrated circuits SDIC, constituting the data driving circuit 130, start data sampling. The source sampling clock SCLK may be a clock signal that may control the timing of sampling data in the source driving integrated circuit SDIC. The source output enable signal SOE may control the output timing of the data driving circuit 130. The display device 100 may further include a power management integrated circuit that may supply various voltages or currents to the display panel 110, the gate driving circuit 120, the data driving circuit 130, or the like, or may control various voltages or currents to be supplied.

The subpixel SP may be located at a region where the gate line GL and the data line DL cross each other, and a light-emitting element may be disposed in each subpixel SP. For example, the organic light-emitting display device may include a light-emitting element, such as an organic light-emitting diode in each subpixel SP, and may display an image by controlling a current flowing through the light-emitting element according to a data voltage. The display device 100 may be various types of devices, such as a liquid crystal display, an organic light-emitting display, and a plasma display panel.

Figure 2:
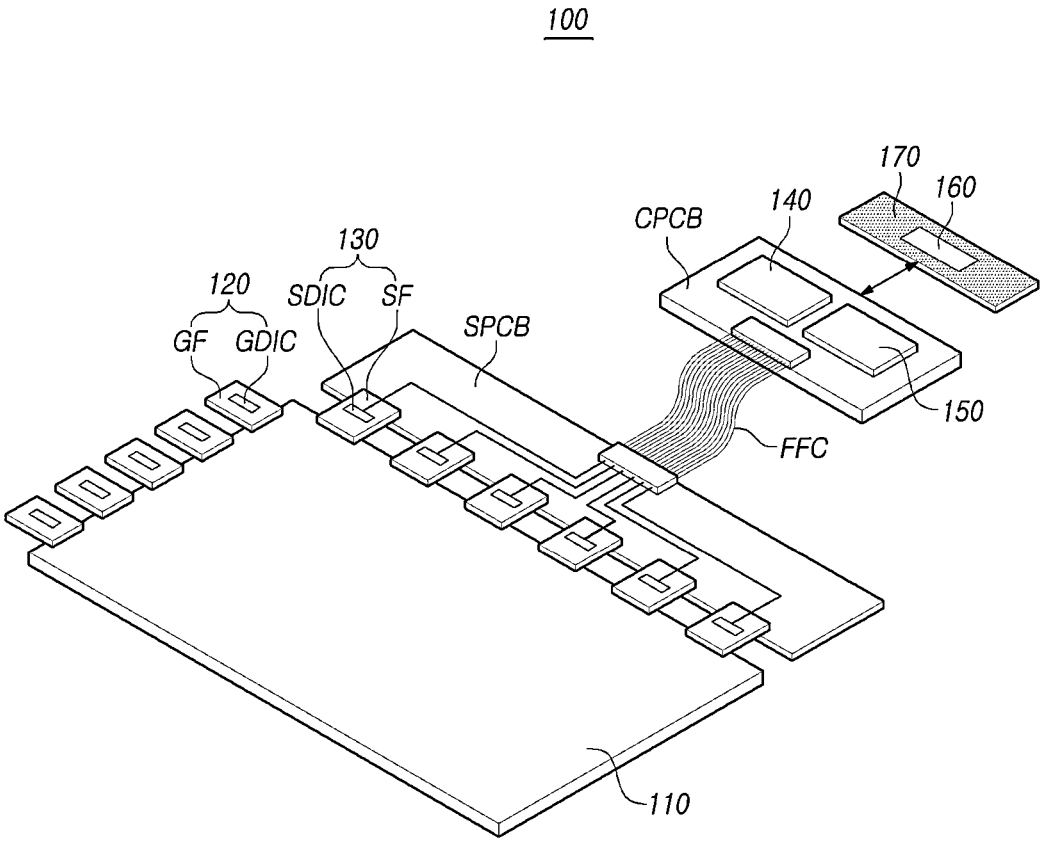
FIG. 2 is an example system diagram of a display device according to embodiments of the present disclosure.

FIG. 2 is an example system diagram of a display device according to embodiments of the present disclosure.

FIG. 2 illustrates a case in which the display device 100, according to an example embodiment of the present disclosure, may include a source driving integrated circuit SDIC included in the data driving circuit 130, and a gate driving circuit 120 implemented in a chip-on-film (COF) method among various methods (e.g., TAB, COG, COF, etc.)

At least one gate driving integrated circuit GDIC, included in the gate driving circuit 120, may be mounted on the gate film GF, respectively, and one side of the gate film GF may be electrically connected to the display panel 110. Also, lines for electrically connecting the gate driving integrated circuit GDIC and the display panel 110 may be disposed on the gate film GF.

Similarly, at least one source driving integrated circuit SDIC, included in the data driving circuit 130, may be mounted on each source film SF, and one side of the source film SF may be electrically connected to the display panel 110. Also, lines for electrically connecting the source driving integrated circuit SDIC and the display panel 110 may be disposed on the source film SF.

The display device 100 may include at least one source printed circuit board SPCB and a control printed circuit board CPCB for mounting control components and various electric devices to connect a plurality of source driving integrated circuits SDIC and other devices. For example, the other side of the source film SF, on which the source driving integrated circuit SDIC may be mounted, may be connected to the at least one source printed circuit board SPCB. That is, one side of the source film SF, on which the source driving integrated circuit SDIC may be mounted, may be electrically connected to the display panel 110, and the other side thereof may be electrically connected to the source printed circuit board SPCB.

A timing controller 140 and a power management integrated circuit PMIC 150 may be mounted on the control printed circuit board CPCB. The timing controller 140 may control operations of the data driving circuit 130 and the gate driving circuit 120. The power management integrated circuit 150 may supply a driving voltage or current to the display panel 110, the data driving circuit 130, the gate driving circuit 120, and the like, and may control the supplied voltage or current.

At least one source printed circuit board SPCB and a control printed circuit board CPCB may be connected through at least one connection member in a circuit structure, and the connection member may include, for example, a flexible printed circuit FPC, a flexible flat cable FFC, or the like. For example, the connection member connecting the at least one source printed circuit board SPCB and the control printed circuit board CPCB may be variously changed according to the size and type of the display device 100. In addition, at least one of the source printed circuit board SPCB and the control printed circuit board CPCB may be implemented by being integrated into one printed circuit board.

The display device 100 may further include a set board 170 electrically connected to a control printed circuit board CPCB. For example, the set board 170 may be referred to as a "power board." The set board 170 may include a main power management circuit M-PMC 160 that may manage the total power of the display device 100. The main power management circuit 160 may be linked (e.g., may communicate) with the power management integrated circuit 150.

In the case of the display device 100 having the above configuration, the driving voltage may be generated at the set board 170, and may be transmitted to the power management integrated circuit 150 in the control printed circuit board CPCB. The power management integrated circuit 150 may transmit the driving voltage, for driving a display or sensing a characteristic value, to a source printed circuit board SPCB through a flexible printed circuit FPC or a flexible flat cable FFC. The driving voltage transmitted to the source printed circuit board SPCB may sense a particular subpixel SP in the display panel 110, or may cause the particular subpixel SP to emit, through the source driving integrated circuit SDIC.

For example, each of the subpixels SP, arranged on the display panel 110 in the display device 100, may include an organic light-emitting diode, which may be a light-emitting device, and a circuit element, such as a driving transistor for driving the subpixel SP. The type and number of circuit elements constituting each subpixel SP may be variously determined according to a provision function and a design method.

Figure 3:
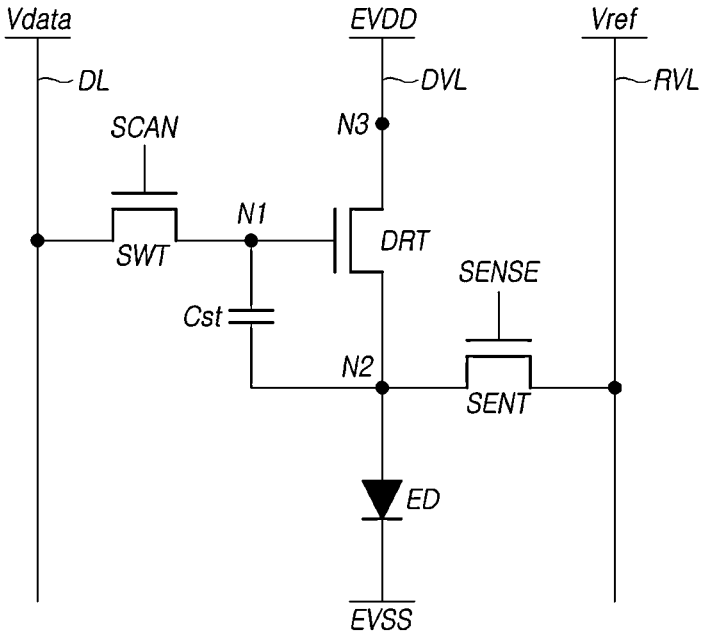
FIG. 3 is an example diagram of a circuit constituting a subpixel in a display device according to example embodiments of the present disclosure.

FIG. 3 is an example diagram of a circuit constituting a subpixel in a display device according to example embodiments of the present disclosure.

With reference to the example of FIG. 3, in the display device 100, according to example embodiments, the subpixel SP may include one or more transistors and a capacitor, and an organic light-emitting diode may be disposed as the light-emitting element ED. For example, the subpixel SP may include a driving transistor DRT, a switching transistor SWT, a sensing transistor SENT, a storage capacitor Cst, and a light-emitting element ED.

The driving transistor DRT may include a first node N1, a second node N2, and a third node N3. The first node N1 of the driving transistor DRT may be a gate node to which the data voltage Vdata may be applied through the data line DL when the switching transistor SWT is turned on. The second node N2 of the driving transistor DRT may be electrically connected to an anode electrode of the organic light-emitting element ED, and may be a source node or a drain node. The third node N3 of the driving transistor DRT may be electrically connected to the driving voltage line DVL to which the driving voltage EVDD may be applied, and may be a drain node or a source node.

For example, during the display driving period, the driving voltage EVDD for driving the display may be supplied to the driving voltage line DVL. For example, the driving voltage EVDD for driving the display may be 27 V.

The switching transistor SWT may be electrically connected between the first node N1 of the driving transistor DRT and the data line DL, and may operate according to a scan signal SCAN supplied by the gate line GL connected to the gate node. In addition, when the switching transistor SWT is turned on, the operation of the driving transistor DRT may be controlled by transferring the data voltage Vdata supplied through the data line DL to the gate node of the driving transistor DRT.

The sensing transistor SENT may be electrically connected between the second node N2 of the driving transistor DRT and a reference voltage line RVL, and may operate according to a scan signal SCAN supplied by the gate line GL connected to the gate node. When the sensing transistor SENT is turned on, a reference voltage Vref supplied through the reference voltage line RVL may be transmitted to the second node N2 of the driving transistor DRT.

That is, by controlling the switching transistor SWT and the sensing transistor SENT, the voltage of the first node N1 and the voltage of the second node N2 of the driving transistor DRT may be controlled, so that the driving current for driving the light-emitting element ED can be supplied. The switching transistor SWT and the sensing transistor SENT may be connected to the same single gate line GL or to different signal lines. For example, the switching transistor SWT and the sensing transistor SENT may be connected to different gate line GL. For example, the switching transistor SWT and the sensing transistor SENT may be independently controlled by the scan signal SCAN and a sense signal SENSE transmitted through different gate lines GL.

When the switching transistor SWT and the sensing transistor SENT are connected to same one gate line GL, the switching transistor SWT and the sensing transistor SENT may be simultaneously controlled by the scan signal SCAN or the sense signal SENSE transmitted through one gate line GL, and the aperture ratio may be increased.

The transistor disposed in the subpixel SP may be formed either an n-type transistor or a p-type transistor. A case of an n-type transistor is illustrated as an example, but one of ordinary skill in the art would understand changing the voltage levels appropriately if a p-type transistor is used.

The storage capacitor Cst may be electrically connected between the first node N1 and the second node N2 of the driving transistor DRT, and may maintain the data voltage Vdata for one frame. The storage capacitor Cst may be connected between the first node N1 and the third node N3 of the driving transistor DRT according to the type of the driving transistor DRT. The anode electrode of the light-emitting element ED may be electrically connected to the second node N2 of the driving transistor DRT, and a base voltage EVSS may be applied to the cathode electrode of the light-emitting element ED.

For example, the base voltage EVSS may be a ground voltage or a voltage higher or lower than the ground voltage. Further, the base voltage EVSS may vary according to the driving state. For example, the base voltage EVSS at the time of driving the image, and the base voltage EVSS at the time of driving the sensing, may be set differently from each other.

The structure of the subpixel SP that is described as an example above may be a 3T (three transistor) 1C (one capacitor) structure, and is only an example for convenience of explanation. The structure of the subpixel SP may further include one or more transistors, or in some cases, may further include one or more capacitors. Alternatively, each of the plurality of subpixels SP may have the same structure, and some of the plurality of subpixels SP may have a different structure.

To effectively sense a characteristic value of the driving transistor DRT, for example, a threshold voltage or mobility in the display device 100 according to the example embodiments of the present disclosure, a method may be used of measuring the current flowing by the voltage charged in the storage capacitor Cst during the sensing period of the characteristic value of the driving transistor DRT, which may be referred as a "current sensing." That is, by measuring the current flowing by the voltage charged in the storage capacitor Cst during the sensing period of the characteristic value of the driving transistor DRT, the characteristic value or the change in the characteristic value of the driving transistor DRT in the subpixel SP may be detected. For example, when the reference voltage line RVL not only transmits the reference voltage Vref, but also serves as a sensing line for sensing the characteristic value of the driving transistor DRT in the subpixel SP, the reference voltage line RVL may be referred to as a "sensing line."

Figure 4:
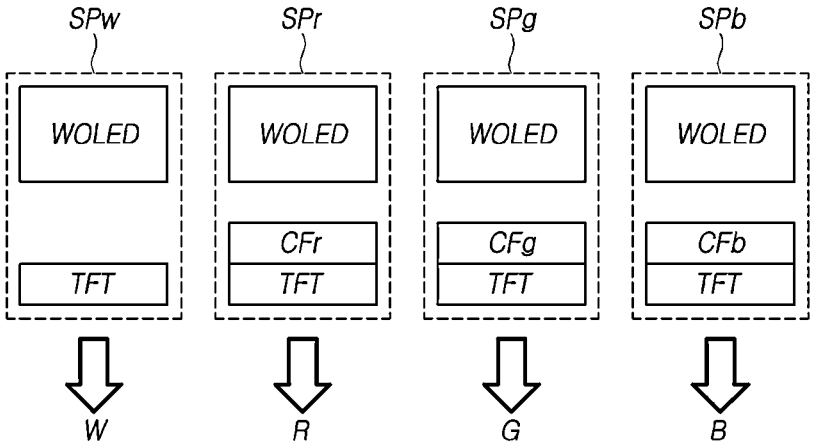
FIG. 4 illustrates a schematic cross-section of a subpixel in a display device according to embodiments of the present disclosure.

FIG. 4 illustrates a schematic cross-section of a subpixel in a display device according to embodiments of the present disclosure.

With reference to the example of FIG. 4, in a display device 100, according to embodiments of the present disclosure, a display panel 110 may have a subpixel structure, including a white subpixel SPw, a red subpixel SPr, a green subpixel SPg, and a blue subpixel SPb, to increase the light efficiency and reduce or prevent the decrease in the luminance and color sense of pure colors. That is, one pixel may include four subpixels SPw, SPr, SPg, SPb, including the white subpixel SPw, the red subpixel SPr, the green subpixel SPg, and the blue subpixel SPb.

For example, an RGB (red, green, blue) subpixel may be referred to as a "colored subpixel," separated from the white subpixel SPw. In addition, the color of the subpixel SP in the pixel is not limited to white, red, green, and blue, and the color may be variously changed according to the type of the display device 100.

One subpixel SP may include a switching transistor SWT, a driving transistor DRT, a storage capacitor Cst, a compensation circuit, and an organic light-emitting element ED. The organic light-emitting element ED may emit light according to a driving current formed by the driving transistor DRT.

The switching transistor SWT may switch so that the data voltage Vdata supplied through the data line DL may be stored in the storage capacitor Cst in response to the scan signal SCAN supplied through the gate line GL. The driving transistor DRT may operate so that driving current may flow between the driving voltage EVDD and the base voltage EVSS, according to the data voltage stored in the storage capacitor Cst. The subpixel SP having such a configuration may be classified into a top-emission method, a bottom-emission method, or a dual-emission method, according to a structure.

The WRGB subpixels SPw, SPr, SPg, SPb may be implemented using a white organic light-emitting diode WOLED and RGB color filters CFr, CFg, CFb, or by dividing and forming light-emitting materials included in organic light-emitting diode into WRGB colors. When using a white organic light-emitting diode WOLED and RGB color filters CFr, CFg, CFb, the RGB subpixel SPr, SPg, SPb may include a transistor TFT, the RGB color filters CFr, CFg, CFb, and a white organic light-emitting diode WOLED, while the white subpixel SPw may include a transistor TFT and a white organic light-emitting diode WOLED.

That is, the RGB subpixel SPr, SPg, SPb may include the RGB color filter CFr, CFg, CFb to convert the white color light transmitted from the white organic light-emitting diode WOLED into red, green, and blue colored light. On the other hand, the white subpixel SPw may not include a color filter because it may directly emit white color light transmitted from the white organic light-emitting diode WOLED.

When using WRGB subpixels SPw, SPr, SPg, SPb, when a white colored light-emitting material is deposited on all subpixels SP, unlike the when red, green, and blue colored light-emitting materials are independently deposited on each subpixel SP, it may be possible to manufacture a large display panel without using a fine metal mask, and there may be an effect of reducing power consumption while extending the lifespan. For example, an example structure of the subpixel has been described, for example, in the organic light-emitting display, however, the present disclosure is not limited to the organic light-emitting display OLED, and embodiments may be applied to any display devices, including the white subpixel SPw and the colored subpixel.

Figure 5:
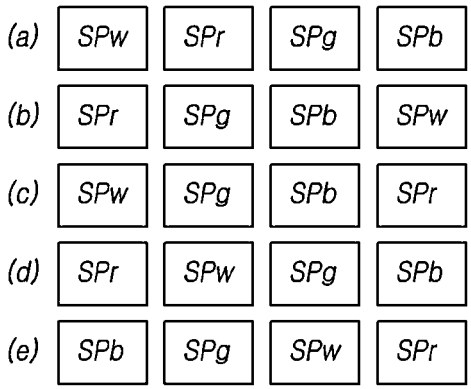
FIG. 5 illustrates an arrangement order of subpixels as an example in a display device according to embodiments of the present disclosure.

FIG. 5 illustrates an arrangement order of subpixels as an example in a display device according to embodiments of the present disclosure.

With reference to the example of FIG. 5, in the display device 100, according to embodiments of the present disclosure, the display panel 110 may variously arrange the subpixels SP to improve color purity or expressiveness, as well as to meet a target color coordinate. For example, the display panel 110 may be arranged in the order of WRGB (white, red, green, blue) subpixels SPw, SPr, SPg, SPb as shown in row (a) of FIG. 5, or may be arranged in the order of RGBW (red, green, blue, white) subpixels SPr, SPg, SPb, SPw, as shown in row (b) of FIG. 5. Alternatively, an arrangement structure of the display panel 110 may be formed in the order of WGBR (white, green, blue, red) subpixels SPw, SPg, SPb, SPr as shown in row (c) of FIG. 5, or in the order of RWGB (red, white, green, blue) subpixels SPr, SPw, SPg, SPb as shown in row (d) of FIG. 5, or in the order of BGWR (blue, green, white, red) subpixels SPb, SPg, SPw, SPr as shown in row (e) of FIG. 5. In addition to this arrangement, the display panel 110 may have a subpixel SP structure arranged in various orders.

The display device 100 having such a structure may emit light in part or all of the RGB subpixels SPr, SPg, SPb, together with the white subpixel SPw, to express a desired color coordinate on the display panel 110 by using WRGB subpixels SPw, SPr, SPg, SPb. For example, the image data input to the display device 100 may be RGB image data, or may be YCbCr image data of various formats, and the timing controller 140 of the display device 100 may convert the input image data into WRGB image data of a 4:4:4 format being matched 1:1 with WRGB subpixels SPw, SPr, SPg, SPb, and may transmit to the corresponding subpixel SP.

Figure 6:
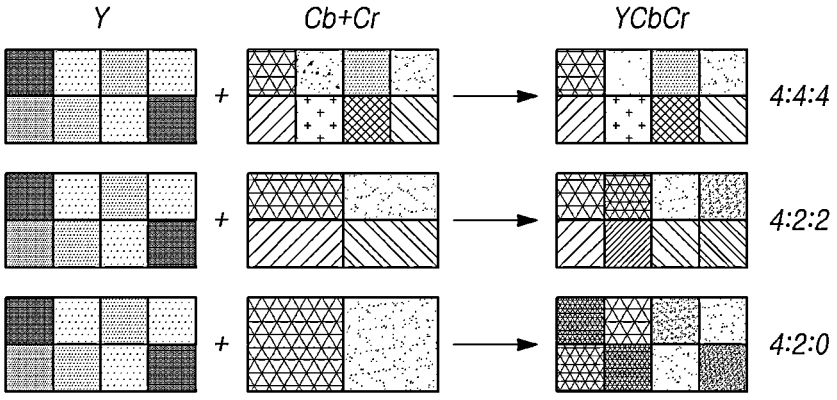
FIG. 6 illustrates an example of image data that can be input to a display device according to embodiments of the present disclosure.

FIG. 6 illustrates an example of image data that can be input to a display device according to embodiments of the present disclosure.

With reference to the example of FIG. 6, the color image data capable of being input to a display device 100 according to embodiments of the present disclosure may be RGB image data, or may be YCbCr image data in a 4:4:4 format, a 4:2:2 format, or a 4:2:0 format. Based on two adjacent 2×2 pixels, the 4:4:4 format represents a format in which the number of samples of luminance data Y and color difference data Cb, Cr in each row is 4. On the other hand, in the 4:2:2 format, the number of samples of luminance data Y in each row is 4, but the number of samples of color difference data Cb, Cr is 2. In addition, in the 4:2:0 format, the number of samples of luminance data Y in each row is 4 and the number of samples of the color difference Cb, Cr is 2, but the number of times the sampling of the color difference data Cb, Cr are changed between the first row and the second row becomes 0, so that the color difference data Cb, Cr of the first row and the second row are the same. That is, in the 4:4:4 format, the color difference data Cb, Cr may be sampled at the same ratio as the luminance data Y, and in the 4:2:2 format, the color difference data Cb, Cr may be sampled at a ratio of 1/2 compared to the luminance data Y, and in the 4:2:0 format, the color difference data Cb, Cr may be sampled at a ratio of 1/4 of the luminance data Y.

For example, YCbCr image data used for TV broadcasts, sports broadcasts, movies, etc. may be in the 4:2:0 format, and YCbCr image data used in games may be in various formats of the 4:4:4 format, 4:2:2 format or 4:2:0 format, and YCbCr image data used in a computer may be in the 4:4:4 format. Accordingly, in the display device 100 having a WRGB subpixel structure, a process may be desired of effectively converting and displaying YCbCr image data into WRGB image data. Embodiments of the present disclosure may provide a display device, a data driving circuit, and a display panel capable of converting and displaying YCbCr image data of 4:2:0 format to be suitable for a WRGB subpixel structure.

Figure 7:
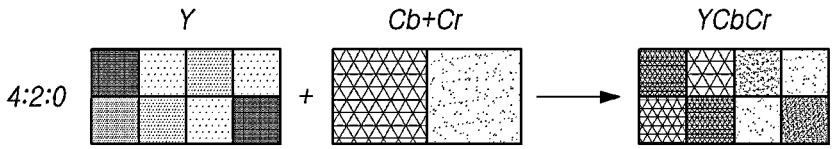
FIG. 7 conceptually illustrates a process of converting YCbCr image data of 4:2:0 format into WRGB image data in a display device according to embodiments of the present disclosure.

FIG. 7 conceptually illustrates a process of converting YCbCr image data of 4:2:0 format into WRGB image data in a display device according to embodiments of the present disclosure.

With reference to the example of FIG. 7, when YCbCr image data of 4:2:0 format is input to a display device 100, according to embodiments of the present disclosure, YCbCr image data may include four luminance data Y and one color difference data Cb, Cr based on 2×2 pixels. That is, in the YCbCr image data of 4:2:0 format, the luminance data Y has one value specified for each pixel, however, the color difference data Cb, Cr has the same value for four pixels of a square structure, including two pixels adjacent in a row direction and two pixels adjacent in a column direction.

When YCbCr image data is received, the display device 100, according to an embodiment of the present disclosure, may first convert the received data into RGB image data corresponding to each pixel. For example, the YCbCr image data may be converted into RGB image data by a host system inside the display device 100, or may be converted into RGB image data by a timing controller 140.

The RGB image data, corresponding to each pixel, can be expressed in a row and column in which the pixel may be located. For example, R11G11B11 may correspond to RGB image data corresponding to a pixel in 1 row and 1 column, and R12G12B12 may correspond to RGB image data corresponding to a pixel in 1 row and 2 columns.

For example, as for YCbCr image data of 4:2:0 format, the color difference data Cb, Cr has the same value for four pixels of a square structure including two pixels adjacent in a row direction and two pixels adjacent in a column direction. For example, all of a color difference data Cb11Cr11 corresponding to a pixel in 1 row and 1 column, a color difference data Cb12Cr12 corresponding to a pixel in 1 row and 2 columns, a color difference data Cb21Cr21 corresponding to a pixel in 2 rows and 1 column, and a color difference data Cb22Cr22 corresponding to a pixel in 2 rows and 2 columns may have the same value.

Accordingly, in the WRGB display device 100 according to an embodiment of the present disclosure, the YCbCr image data may be displayed as WRGB image data by matching luminance data Y included in the 4:2:0 format YCbCr image data to one white subpixel SPw, and by matching the color component data included in one color difference data CbCr to two adjacent RGB subpixels SPr, SPg, SPb in the row direction and the column direction together. As such, in the display device 100 according to an embodiment of the present disclosure, the same data voltage corresponding to one color component data may be applied to each of two RGB subpixels SPr, SPg, and SPb, adjacent in the row direction, through the structure of the data line DL formed on the display panel 110, and two adjacent RGB subpixels SPr, SPg, SPb, to which image data may be applied, may be combined in a column direction, so that 4:2:0 YCbCr image data can be displayed as WRGB image data.

Figure 8:
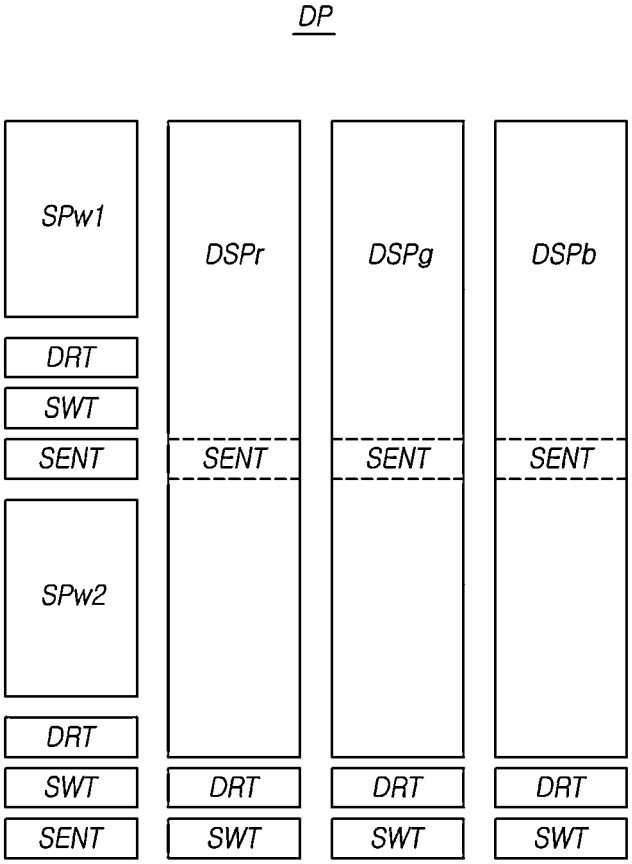
FIG. 8 conceptually illustrates a structure of a subpixel for processing image data of 4:2:0 format as WRGB image data in a display device according to embodiments of the present disclosure.

FIG. 8 conceptually illustrates a structure of a subpixel for processing image data of 4:2:0 format as WRGB image data in a display device according to embodiments of the present disclosure.

With reference to the example of FIG. 8, in the display device 100 according to an embodiment of the present disclosure, two white subpixels SPw1 and SPw2 may be disposed in a column direction to which image data may be applied, and RGB dual subpixels DSPr, DSPg, DSPb may be disposed for an RGB subpixel in the column direction. The RGB dual subpixels DSPr, DSPg, DSPb may correspond to the RGB subpixels formed in a size corresponding to the two white subpixels SPw1, SPw2 arranged in the column direction. That is, each of RGB dual subpixels DSPr, DSPg, DSPb may correspond to the size of two white subpixels SPw1, SPw2 in the column direction.

Therefore, the data voltage may be supplied to the two white subpixels SPw1, SPw2, arranged in the column direction, through the two data lines DL, but each of the RGB dual subpixels DSPr, DSPg, DSPb, corresponding to the sizes of the two white subpixels SPw1, SPw2, may each receive an image data voltage through one data line DL. In other words, because, in the YCbCr image data of the 4:2:0 format, the RGB subpixels of the same color that are adjacent to the column direction have the same data voltage, the data voltage may be supplied through one data line by forming RGB dual subpixels DSPr, DSPg, DSPb with a size corresponding to the white subpixels SPw1, SPw2 that are adjacent in the column direction.

Therefore, each dual subpixel DSPr, DSPg, DSPb may be a subpixel having an area or area size including RGB subpixels of the same color, adjacent in the column direction, among the smallest unit RGB subpixels, and having a size corresponding to the white subpixels SPw1, SPw2. For example, the white subpixels SPw1, SPw2 in the column direction may not be formed in the size of the dual subpixels DSPr, DSPg, DSPb because the luminance data Y may be individually applied. However, because only two RGB subpixels, adjacent in the column direction, may be formed as dual subpixels DSPr, DSPg, DSPb, it may be considered that two white subpixels SPw1, SPw2, arranged in the column direction, and three dual subpixels DSPr, DSPg, DSPb may be formed as one dual pixel DP.

For example, when the two white subpixels SPw1 and SPw2 arranged in the column direction are electrically separated from each other, a first white subpixel SPw1 and a second white subpixel SPw2 may include respectively a driving transistor DRT and a switching transistor SWT, and a sensing transistor SENT. On the other hand, because the dual subpixels DSPr, DSPg, DSPb have a size corresponding to the two white subpixels SPw1, SPw2 in the column direction, respectively, the driving transistor DRT, the switching transistor SWT and the sensing transistor SENT arranged in each dual subpixel DSPr, DSPg, DSPb may be formed in half the number of those disposed in the two white subpixels SPw1, SPw2.

Accordingly, the sensing transistor SENT of the dual subpixel DSPr, DSPg, DSPb may be disposed at a position corresponding to the first white subpixel SPw1, but the driving transistor DRT and the switching transistor SWT of the dual subpixel DSPr, DSPg, DSPb may be arranged at a position corresponding to the second white subpixel SPw2, so that the circuit area may be reduced, and the light-emitting area can be increased to improve the aperture ratio. For example, it has been illustrated, as an example, a case in which the sensing transistor SENT of the dual subpixels DSPr, DSPg, DSPb are disposed at a position corresponding to the first white subpixel SPw1. However, the switching transistor SWT of the dual subpixels DSPr, DSPg, DSPb may be disposed at a position corresponding to the first white subpixel SPw1, or the driving transistor DRT may be disposed at a position corresponding to the first white subpixel SPw1.

The driving transistor DRT of the dual subpixels DSPr, DSPg, DSPb may be selectively disposed at a position corresponding to the first white subpixel SPw1 or the second white subpixel SPw2. However, the sensing transistor SENT and the switching transistor SWT of the dual subpixels DSPr, DSPg, DSPb may be alternately arranged at positions corresponding the first white subpixels SPw1 and the second white subpixels SPw2, in consideration of the separation distance between the sense signal SENSE and the scan signal SCAN applied through the adjacent gate line GL.

Accordingly, in a dual pixel DP structure, in which RGB subpixels of the same color adjacent in the column direction may be composed of one dual subpixel DSPr, DSPg, DSPb, when RGB dual subpixels DSPr, DSPg, DSPb, located adjacent to each other in the row direction, are connected with one data line DL, the data voltage corresponding to the color component data can be applied to two adjacent dual subpixels DSPr, DSPg, DSPb in the row and column directions. As a result, 4:2:0 YCbCr image data can be effectively displayed as WRGB image data.

Figure 9:
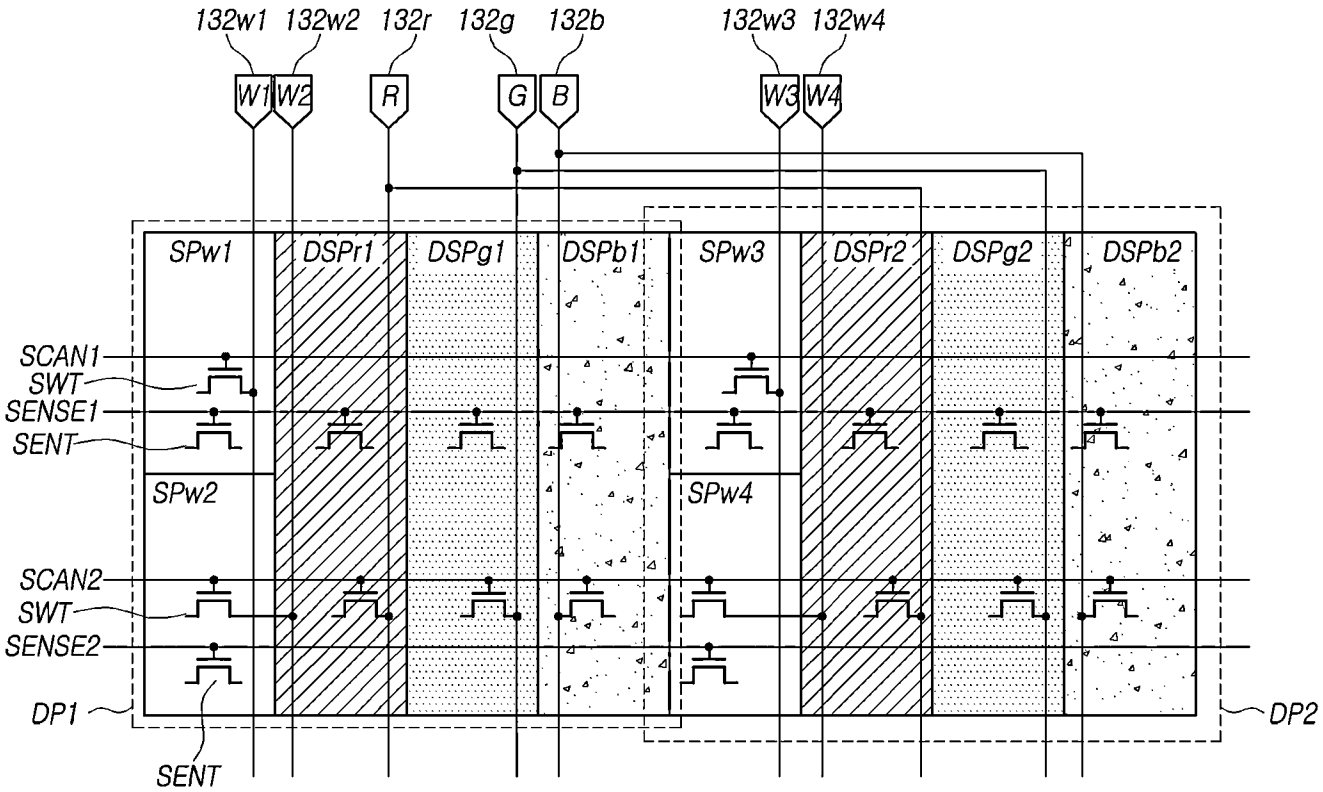
FIG. 9 illustrates a signal line connection structure for processing image data of 4:2:0 format as WRGB image data in a display device according to embodiments of the present disclosure.

FIG. 9 illustrates a signal line connection structure for processing image data of 4:2:0 format as WRGB image data in a display device according to embodiments of the present disclosure.

With reference to the example of FIG. 9, according to the display device 100, according to an embodiment of the present disclosure, in a dual pixel DP structure in which RGB subpixels of the same color, adjacent in the column direction, are composed of one dual subpixel DSPr, DSPg, DSPb, two adjacent dual subpixels (DSPr1 and DSPr1, DSPg1 and DSPg2, DSPb1 and DSPb2), having the same color in the row direction, may be each with one data line DL, so that YCbCr image data of 4:2:0 format can be displayed as WRGB image data. For example, the white subpixels SPw1, SPw2, SPw3, SPw4, in the column direction, may not be formed in the size of the dual subpixels DSPr1, DSPg1, DSPb1 because the luminance data Y may be individually applied. However, because only two RGB subpixels, adjacent in the column direction, may be formed as dual subpixels DSPr1, DSPg1, DSPb1, it may be considered that the two white subpixels SPw1, SPw2 and three dual subpixels DSPr1, DSPg1, DSPb1, arranged in the column direction, may be formed as one dual pixel DP1.

In such a structure of the dual pixels DP1, DP2, two data lines corresponding to the first dual subpixel DSPr1 and the second dual subpixel DSPr2 of red color, adjacent to each other in the row direction, may be connected to one red data pad 132*r*, so that a data voltage corresponding to the same color component can be applied to two adjacent red-colored dual subpixels DSPr1, DSPr2 in the row and column directions. Similarly, two data lines corresponding to the first dual subpixel DSPg1 and the second dual subpixel DSPg2 of green color, adjacent to each other in the row direction, may be connected together to one green data pad 132*g*, and two data lines corresponding to the first dual subpixel DSPb1 and the second dual subpixel DSPb2 of blue color, adjacent to each other in the row direction, may be together connected to one blue data pad 132*b*. Because the white subpixels SPw1 and SPw2 adjacent in the column direction correspond to different luminance data Y in a state separated from each other, the data line corresponding to the first white subpixel SPw1 and the data line corresponding to the second white subpixel SPw2 may be individually connected to different white data pads 132*w*1, 132*w*2, respectively.

As described above, in a dual pixel structure, in which RGB subpixels adjacent in a column direction may be formed in a larger area than a white subpixel, because the same data voltage corresponding to one color component data may be applied to two adjacent dual subpixels (DSPr1 and DSPr2, DSPg1 and DSPg2, DSPb1 and DSPb2) having the same color in the row direction, the dual subpixels DSPr1, DSPr2, DSPg1, DSPg2, DSPb1, DSPb2 having a square structure adjacent to each other in a row direction and a column direction may be simultaneously emitted to correspond to the image data of 4:2:0 format. For example, for eight columns of subpixels SP, the data voltage may be applied through four white data pads 132*w*1, 132*w*2, 132*w*3, 132*w*4, respectively connected to four white subpixels SPw1, SPw2, SPw3, SPw4, and through the three RGB data pads 132*r*, 132*g*, 132*b* connected to three pairs of RGB dual subpixels (DSPr1 and DSPr2, DSPg1 and DSPg2, and DSPb1 and DSPb2).

Accordingly, because seven data lines DL and signal pads 132 may be required with respect to the eight columns of subpixels SP, the configuration of a latch circuit, a digital-to-analog converter, and an output buffer constituting the data driving circuit 130 may be reduced, and the number of data driving circuits 130 in the display panel 110 can be reduced.

For example, because the RGB subpixels include RGB dual subpixels DSPr1, DSPg1, DSPb1 formed in a larger area than the white subpixels SPw1, SPw2 in the column direction, whereas the white subpixels SPw1, SPw2 may be formed in a smaller area than the dual subpixels, a first scan signal SCAN1 may be applied based on the upper first white subpixel SPw1 and a second scan signal SCAN2 may be applied based on the lower second white subpixel SPw2. For example, as described above, the switching transistor SWT, the sensing transistor SENT, and the driving transistor DRT for driving the RGB dual subpixels DSPr1, DSPg1, DSPb1, . . . may be disposed in an area corresponding to the upper first white subpixel SPw1, or may be disposed in an area corresponding to the lower second white subpixel SPw2.

However, the sensing transistor SENT and the switching transistor SWT of the dual subpixels DSPr, DSPg, DSPb may be alternately arranged at positions corresponding to the first white subpixel SPw1 and the second white subpixel SPw2, in consideration of the separation distance between the scan signal SCAN and the sense signal SENSE applied through the adjacent gate line GL. For example, the sensing transistor SENT of the RGB dual subpixels DSPr1, DSPg1, DSPb1, . . . may be connected to the first sense signal SENSE1 for driving the first white subpixel SPw1, and the switching transistor SWT of the RGB dual subpixels DSPr1, DSPg1, DSPb1, . . . may be connected to the second scan signal SCAN2 for driving the second white subpixel SPw2.

According to embodiments of the present disclosure, in a dual pixel DP structure, in which RGB subpixels of the same color adjacent to each other in the column direction include one dual subpixel DSPr, DSPg, DSPb, the arrangement of signal lines may be determined in consideration of the positions of the white subpixels SPw1, SPw2 formed in a smaller area than the dual subpixels DSPr, DSPg, DSPb, so that the aperture ratio of the dual pixel DP can be improved.

Figure 10:
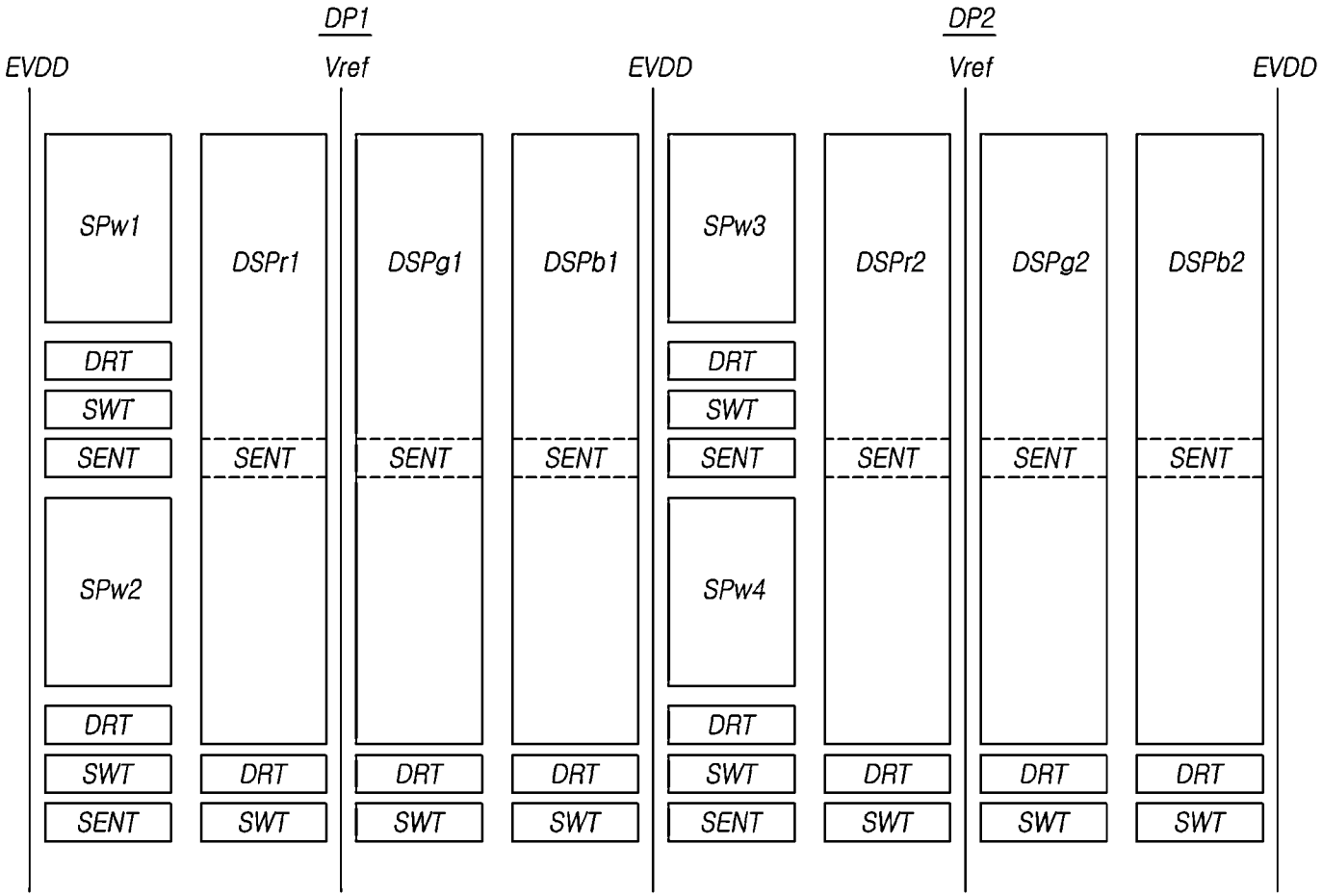
FIG. 10 illustrates an example arrangement of signal lines in a WRGB dual pixel structure for processing image data of 4:2:0 format in a display device according to embodiments of the present disclosure.

FIG. 10 illustrates an example arrangement of signal lines in a WRGB dual pixel structure for processing image data of 4:2:0 format in a display device according to embodiments of the present disclosure.

With reference to the example of FIG. 10, in the display device 100, according to an embodiment of the present disclosure, two white subpixels SPw1, SPw2 may be disposed in a column direction to which image data may be applied, and RGB dual subpixels DSPr, DSPg, and DSPb may be disposed for an RGB subpixel in the column direction. Therefore, the data voltage may be supplied to the two white subpixels SPw1, SPw2, arranged in the column direction, through the two data lines DL, but each of the RGB dual subpixels DSPr, DSPg, DSPb, corresponding to the sizes of the two white subpixels SPw1 and SPw2, may each receive the data voltage through one data line DL.

For example, because the two white subpixels SPw1, SPw2, arranged in the column direction, are electrically separated from each other, a first white subpixel SPw1 and a second white subpixel SPw2 may include respectively a driving transistor DRT and a switching transistor SWT, and a sensing transistor SENT. On the other hand, because the dual subpixels DSPr, DSPg, DSPb have a size corresponding to the two white subpixels SPw1, SPw2 in the column direction, respectively, the driving transistor DRT, the switching transistor SWT, and the sensing transistor SENT, arranged in each dual subpixel DSPr, DSPg, DSPb, may be formed in half the number of those disposed in the two white subpixels SPw1 and SPw2. Accordingly, the sensing transistor SENT of the dual subpixel DSPr, DSPg, DSPb may be disposed at a position corresponding to the first white subpixel SPw1, but the driving transistor DRT and the switching transistor SWT of the dual subpixel DSPr, DSPg, DSPb may be arranged at a position corresponding to the second white subpixel SPw2, so that the circuit area may be reduced and the light-emitting area can be increased to improve the aperture ratio.

The driving transistor DRT of the dual subpixels DSPr, DSPg, DSPb may be selectively disposed at a position corresponding to the first white subpixel SPw1 or the second white subpixel SPw2. However, the sensing transistor SENT and the switching transistor SWT of the dual subpixels DSPr, DSPg, DSPb may be desirable to be alternately arranged at positions corresponding the first white subpixels SPw1 and the second white subpixels SPw2, in consideration of the separation distance between the sense signal SENSE and the scan signal SCAN applied through the adjacent gate line GL.

In a dual pixel DP structure, in which RGB subpixels of the same color adjacent in the column direction include one dual subpixel DSPr, DSPg, DSPb, a signal supplied to the dual pixel DP, together with the data voltage, may include a driving voltage EVDD and a reference voltage Vref. For example, the driving voltage EVDD may be applied to the drain node (or source node) of the driving transistor DRT, and the reference voltage Vref may be applied to the drain node (or source node) of the sensing transistor SENT. Accordingly, the aperture ratio of the display panel 110 can be improved by effectively disposing the driving voltage line supplying the driving voltage EVDD to the dual pixel DP and the reference voltage line supplying the reference voltage Vref.

For example, when the display panel 110 has a WRGB dual pixel DP1 structure, arranged in the order of white subpixels SPw1, SPw2, a red-colored dual subpixel DSPr1, a green-colored dual subpixel DSPg1, and a blue-colored dual subpixel DSPb1, the white subpixels SPw1, SPw2, including two driving transistors DRT, two switching transistors SWT, and two sensing transistors SENT, may be located at the edge of the dual pixel DP1. Accordingly, in the WRGB dual pixel DP structure, the driving voltage line, to which the driving voltage EVDD may be supplied, may extend in the column direction along the boundary of the dual pixels DP close to the white subpixels SPw1, SPw2.

For example, if the structure of the WRGB dual pixel DP is identically repeated, the driving voltage line to which the driving voltage EVDD may be supplied may be repeatedly disposed between the WRGB dual pixels DP. When the driving voltage line is repeatedly arranged between the WRGB dual pixels DP, the reference voltage line supplying the reference voltage Vref may be disposed, for the efficient arrangement of signal lines, at an intermediate position between the driving voltage lines within one dual pixel DP. For example, in the case of the WRGB dual pixel DP1 structure, in which the white subpixels SPw1, SPw2, the red-colored dual subpixel DSPr1, the green-colored dual subpixel DSPg1, and the blue-colored dual subpixel DSPb1 are arranged in this order, the reference voltage line may extend in a column direction in a space between the red-colored dual subpixel DSPr1 and the green-colored dual subpixel DSPg1 corresponding to the center of the dual pixel DP1.

Figure 11:
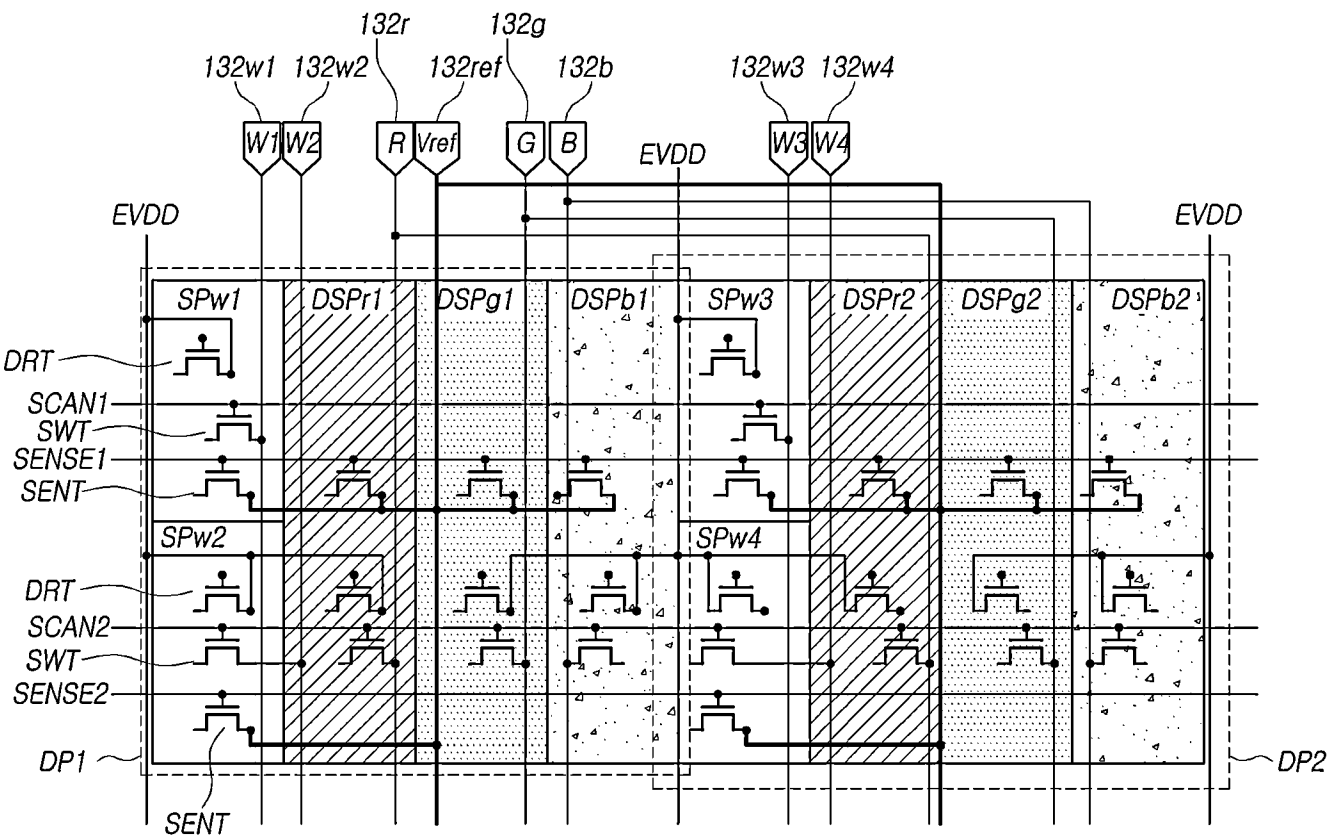
FIG. 11 is a more detailed diagram illustrating a structure of a dual pixel and signal line connection for processing image data of 4:2:0 format as WRGB image data in a display device according to example embodiments of the present disclosure.

FIG. 11 is a more detailed diagram illustrating a structure of a dual pixel and signal line connection for processing image data of 4:2:0 format as WRGB image data in a display device according to example embodiments of the present disclosure.

With reference to the example of FIG. 11, according to the display device 100, according to an embodiment of the present disclosure, in a dual pixel DP structure, in which RGB subpixels of the same color, adjacent in the column direction, include one dual subpixel DSPr, DSPg, DSPb, two adjacent dual subpixels (DSPr1 and DSPr1, DSPg1 and DSPg2, DSPb1 and DSPb2) having the same color in the row direction may be each with one data line DL, so that YCbCr image data of 4:2:0 format can be displayed as WRGB image data. For example, the white subpixels SPw1, SPw2, SPw3, SPw4, in the column direction, may be not formed in the size of the dual subpixels DSPr1, DSPg1, DSPb1 because the luminance data Y may be individually applied. However, when only two RGB subpixels adjacent in the column direction are formed as dual subpixels DSPr1, DSPg1, DSPb1, it may be considered that the two white subpixels SPw1, SPw2 and three dual subpixels DSPr1, DSPg1, DSPb1, arranged in the column direction, may be formed as one dual pixel DP1.

In such a structure of the dual pixels DP1, DP2, two data lines corresponding to a first dual subpixel DSPr1 and a second dual subpixel DSPr2 of red color adjacent to each other in the row direction may be connected to one red data pad 132*r*, two data lines corresponding to the first dual subpixel DSPg1 and the second dual subpixel DSPg2 of green color adjacent to each other in the row direction may be connected together to one green data pad 132*g*, and two data lines corresponding to the first dual subpixel DSPb1 and the second dual subpixel DSPb2 of blue color adjacent to each other in the row direction may be together connected to one blue data pad 132*b*. Accordingly, a data voltage corresponding to the same color component may be applied to two dual subpixels (DSPr1 and DSPr2, DSPg1 and DSPg2, and DSPb1 and DSPb2) that are adjacent in the row direction.

As described above, in a dual pixel structure, in which RGB subpixels adjacent in a column direction are formed in a larger area than a white subpixel, because the same data voltage corresponding to one color component data may be applied to each of two adjacent dual subpixels (DSPr1 and DSPr2, DSPg1 and DSPg2, DSPb1 and DSPb2) having the same color in the row direction, the dual subpixels DSPr1, DSPr2, DSPg1, DSPg2, DSPb1, DSPb2, having a square structure adjacent to each other in a row direction and a column direction, may be simultaneously emitted to correspond to the image data of 4:2:0 format. For example, because the RGB subpixels constitute RGB dual subpixels DSPr1, DSPg1, DSPb1 formed in a larger area than the white subpixels SPw1, SPw2 in the column direction, whereas the white subpixels SPw1, SPw2 may be formed in a smaller area than the dual subpixels, a first scan signal SCAN1 may be applied based on the upper first white subpixel SPw1 and a second scan signal SCAN2 may be applied based on the lower second white subpixel SPw2.

For example, as described above, the switching transistor SWT, the sensing transistor SENT and the driving transistor DRT for driving the RGB dual subpixels DSPr1, DSPg1, DSPb1, . . . may be disposed in an area corresponding to the upper first white subpixel SPw1, or may be disposed in an area corresponding to the lower second white subpixel SPw2. The driving transistor DRT of the dual subpixels DSPr, DSPg, DSPb may be selectively disposed at a position corresponding to the first white subpixel SPw1 or the second white subpixel SPw2. However, the sensing transistor SENT and the switching transistor SWT of the dual subpixels DSPr, DSPg, DSPb may be alternately arranged at positions corresponding to the first white subpixel SPw1 and the second white subpixel SPw2, in consideration of the separation distance between the scan signal SCAN and the sense signal SENSE applied through the adjacent gate line GL.

When the display panel 110 has a WRGB dual pixel DP1 structure, arranged in the order of white subpixels SPw1, SPw2, the red-colored dual subpixel DSPr1, the green-colored dual subpixel DSPg1, and the blue-colored dual subpixel DSPb1, because the white subpixels SPw1 and SPw2, including two driving transistors DRT, two switching transistors DRT, and two sensing transistors SENT may be located at the edge of the dual pixel DP1, the driving voltage line to which the driving voltage EVDD may be supplied may be disposed along an outer line of the dual pixel DP close to the white subpixels SPw1, SPw2. Accordingly, if the structure of the WRGB dual pixel DP is identically repeated, the driving voltage line for supplying the driving voltage EVDD may be repeatedly disposed between the WRGB dual pixels DP. In addition, the reference voltage line supplying the reference voltage Vref through the reference voltage pad 132ref may be disposed at an intermediate position between the driving voltage lines for efficient arrangement of the signal lines.

Figure 12:
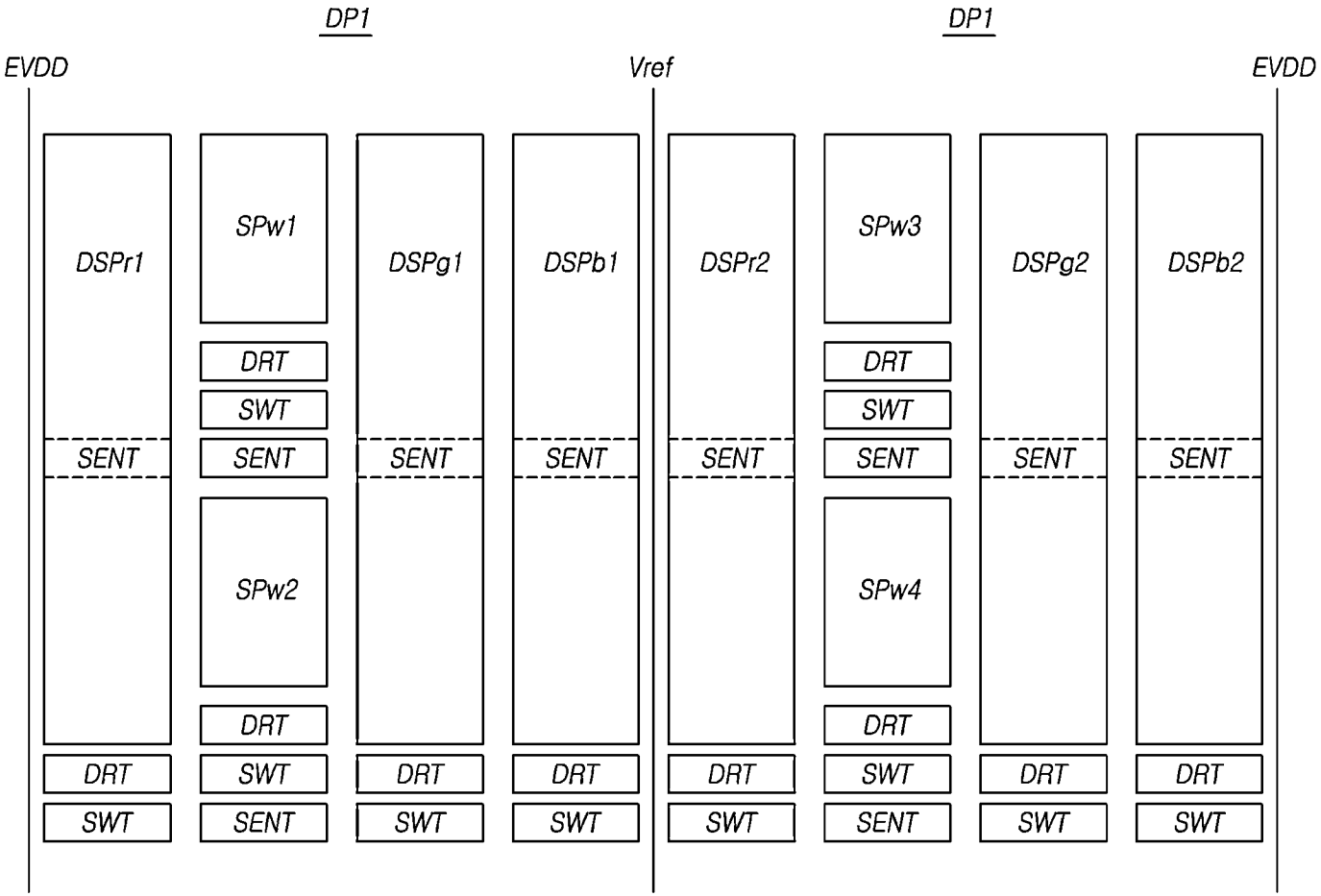
FIG. 12 illustrates an example arrangement of signal lines in an RWGB dual pixel structure for processing image data of 4:2:0 format in a display device according to embodiments of the present disclosure.
Figure 13:
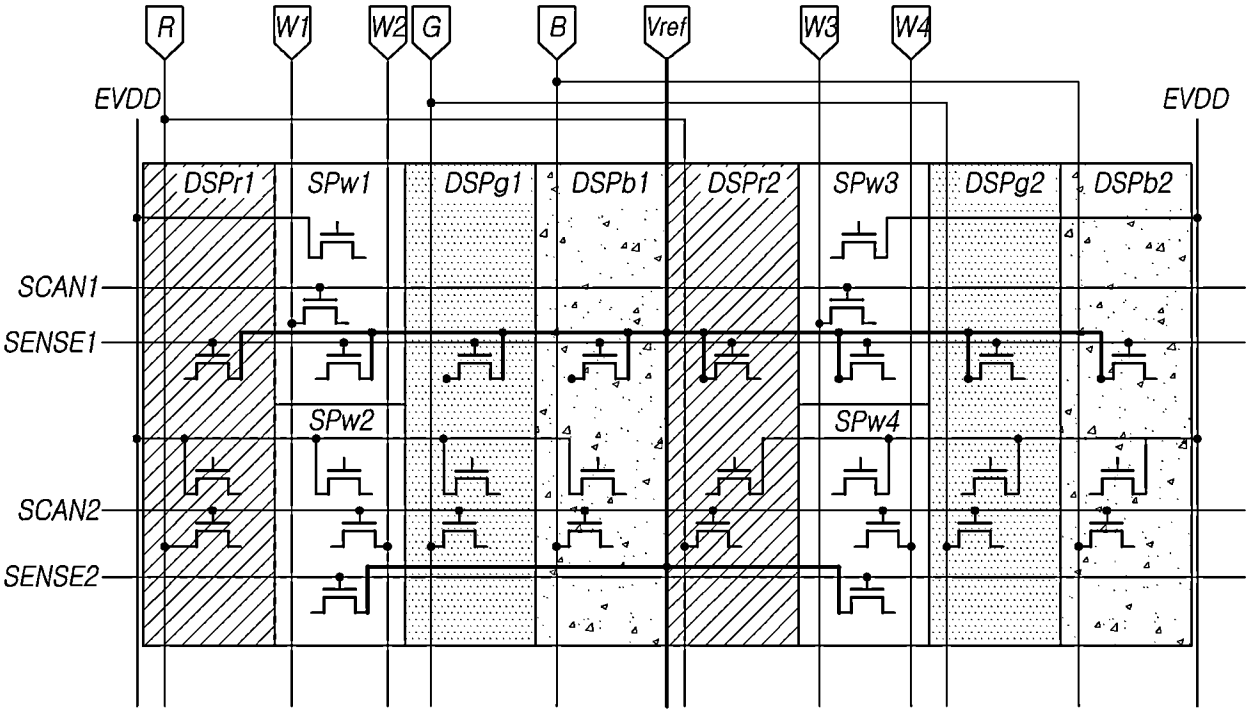
FIG. 13 is a more detailed diagram illustrating a structure of a dual pixel and signal line connection for processing image data of 4:2:0 format as RWGB image data in a display device according to example embodiments of the present disclosure.

FIG. 12 illustrates an example arrangement of signal lines in an RWGB dual pixel structure for processing image data of 4:2:0 format in a display device according to embodiments of the present disclosure. FIG. 13 is a more detailed diagram illustrating a structure of a dual pixel and signal line connection for processing image data of 4:2:0 format as RWGB image data in a display device according to example embodiments of the present disclosure.

With reference to the examples of FIG. 12 and FIG. 13, in the display device 100, according to an embodiment of the present disclosure, two white subpixels SPw1, SPw2 may be disposed in a column direction to which image data may be applied, and RGB dual subpixels DSPr, DSPg, DSPb may be disposed for an RGB subpixel in the column direction. Therefore, the data voltage may be supplied to the two white subpixels SPw1, SPw2, arranged in the column direction, through the two data lines DL. However, the data voltages may be respectively supplied to the RGB dual subpixels DSPr, DSPg, DSPb, corresponding to the sizes of the two white subpixels SPw1, SPw2, through one same data line DL.

For example, because the two white subpixels SPw1, SPw2 arranged in the column direction are electrically separated from each other, a first white subpixel SPw1 and a second white subpixel SPw2 may include respectively a driving transistor DRT and a switching transistor SWT, and a sensing transistor SENT. On the other hand, because the dual subpixels DSPr, DSPg, DSPb have a size corresponding to the two white subpixels SPw1, SPw2 in the column direction, respectively, the driving transistor DRT, the switching transistor SWT, and the sensing transistor SENT, arranged in each dual subpixel DSPr, DSPg, DSPb, may be formed in half the number of those disposed in the two white subpixels SPw1, SPw2.

Accordingly, the sensing transistor SENT of the dual subpixel DSPr, DSPg, DSPb may be disposed at a position corresponding to the first white subpixel SPw1, but the driving transistor DRT and the switching transistor SWT of the dual subpixel DSPr, DSPg, DSPb may be arranged at a position corresponding to the second white subpixel SPw2, so that the circuit area may be reduced, and the light-emitting area can be increased to improve the aperture ratio.

The driving transistor DRT of the dual subpixels DSPr, DSPg, DSPb may be selectively disposed at either a position corresponding to the first white subpixel SPw1 or a position corresponding to the second white subpixel SPw2. However, the sensing transistor SENT and the switching transistor SWT of the dual subpixels DSPr, DSPg, DSPb may be alternately arranged at positions corresponding to the first white subpixels SPw1 and the second white subpixels SPw2, in consideration of the separation distance between the sense signal SENSE and the scan signal SCAN applied through the adjacent gate line GL.

When the display panel 110 has a WRGB dual pixel DP1 structure, arranged in the order of the red-colored dual subpixel DSPr1, the white subpixels SPw1, SPw2, the green-colored dual subpixel DSPg1, and the blue-colored dual subpixel DSPb1, the white subpixels SPw1, SPw2, including two driving transistors DRT, two switching transistors DRT, and two sensing transistors SENT, may be located at a central portion of the dual pixel DP1. Therefore, in the RWGB dual pixel DP structure, the driving voltage line, supplying the driving voltage EVDD, may not be located between the RWGB dual pixels DP1, DP2. For example, the driving voltage line, supplying the driving voltage EVDD and a reference voltage line supplying the reference voltage Vref, may be alternately disposed between the RWGB dual pixels DP1, DP2.

A case has been described in which the number of the driving transistor DRT, the switching transistor SWT, and the sensing transistor SENT, disposed in dual subpixels DSPr, DSPg, DSPb having a size corresponding to two white subpixels SPw1, SPw2, in the column direction, is less that those arranged in two white subpixels SPw1, SPw2. The number of driving transistors DRT, switching transistors SWT, and sensing transistors SENT arranged in dual subpixels DSPr, DSPg, DSPb may be same as that arranged in the two white subpixels SPw1, SPw2 in consideration of the efficiency of the manufacturing process, etc.

Figure 14:
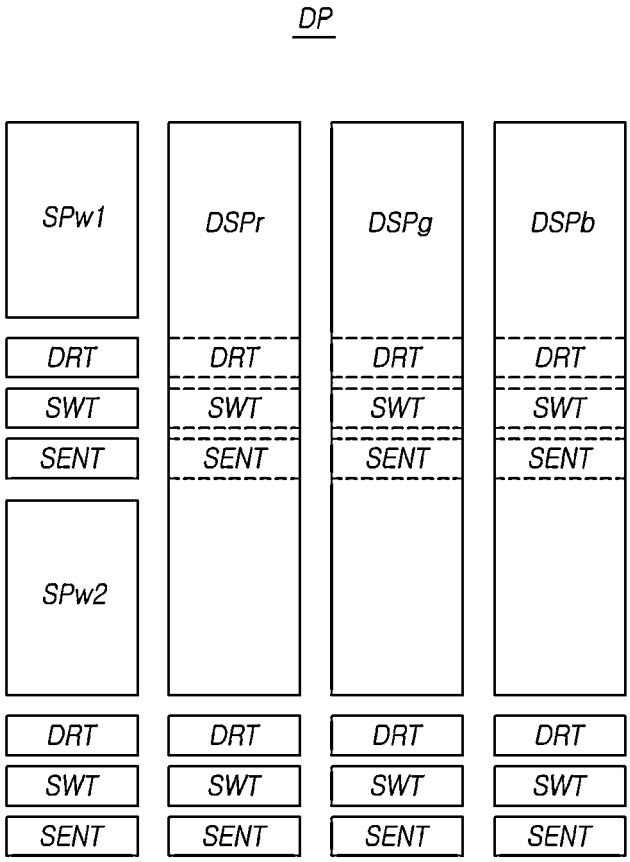
FIG. 14 conceptually illustrates another structure of a subpixel for processing image data of 4:2:0 format as WRGB image data in a display device according to embodiments of the present disclosure.

FIG. 14 conceptually illustrates another structure of a subpixel for processing image data of 4:2:0 format as WRGB image data in a display device according to embodiments of the present disclosure.

With reference to the example of FIG. 14, in the display device 100, according to an embodiment of the present disclosure, two white subpixels SPw1, SPw2 may be disposed in a column direction to which image data may be applied, and RGB dual subpixels DSPr, DSPg, DSPb may be disposed for an RGB subpixel in the column direction. Therefore, each of the dual subpixel DSPr, DSPg, DSPb may be a subpixel having an area or area size including RGB subpixels of the same color adjacent in the column direction among the smallest unit RGB subpixels, and having a size corresponding to two white subpixels SPw1 and SPw2.

For example, the white subpixels SPw1 and SPw2, in the column direction, may be not formed in the size of the dual subpixels DSPr, DSPg, DSPb because the luminance data Y may be individually applied. However, because only two RGB subpixels, adjacent in the column direction, may be formed as dual subpixels DSPr, DSPg, DSPb, it may be considered that two white subpixels SPw1, SPw2, arranged in the column direction, and three dual subpixels DSPr, DSPg, DSPb may be formed as one dual pixel DP.

For example, because the two white subpixels SPw1, SPw2 arranged in the column direction are electrically separated from each other, each of a first white subpixel SPw1 and a second white subpixel SPw2 may include a driving transistor DRT and a switching transistor SWT and a sensing transistor SENT. On the other hand, because the dual subpixels DSPr, DSPg, DSPb each have a size corresponding to two white subpixels SPw1, SPw2 in the column direction, the driving transistor DRT, the number of the switching transistor SWT, and the sensing transistor SENT disposed in dual subpixels DSPr, DSPg, DSPb may be less that those arranged in two white subpixels SPw1, SPw2. However, the number of driving transistors DRT, switching transistors SWT, and sensing transistors SENT arranged in dual subpixels DSPr, DSPg, DSPb may be same as that arranged in the two white subpixels SPw1, SPw2, in consideration of the efficiency of the manufacturing process, etc.

For example, because the driving transistor DRT may be disposed for each of the dual subpixels DSPr, DSPg, DSPb and two white subpixels SPw1, SPw2, the driving voltage line for supplying the driving voltage EVDD to the drain node (or source node) of the driving transistor DRT may extend in the row direction. Accordingly, the driving voltage line supplying the driving voltage EVDD, and the reference voltage line supplying the reference voltage Vref, may be configured to be alternately arranged between the dual pixels DP, and may extend in a row direction to contact a transistor to be electrically connected in the dual pixel DP.

As described above, the aperture ratio can be improved by using a dual pixel DP structure, in which RGB subpixels of the same color, adjacent in the column direction, include one dual subpixel DSPr, DSPg, DSPb. In addition, if RGB dual subpixels DSPr, DSPg, DSPb, located adjacent to each other in the row direction, are connected with one data line DL, the data voltage corresponding to the same color component data can be applied to two adjacent dual subpixels DSPr, DSPg, DSPb in the row and column directions, thereby effectively displaying 4:2:0 YCbCr image data as WRGB image data.

Embodiments of the present disclosure may provide a display device including a display panel in which pixels including a white subpixel and a colored subpixel may be arranged in a matrix form, and subpixels may be disposed in a region where a plurality of gate lines extending in a first direction and a plurality of data lines extending in a second direction intersect, a gate driving circuit driving the plurality of gate lines, a data driving circuit driving the plurality of data lines, and a timing controller for controlling the gate driving circuit and the data driving circuit, wherein luminance data may be applied to the white subpixel, and the colored subpixel may include dual subpixel corresponding to the size of two white subpixels arranged in the second direction, and two dual subpixels adjacent to the first direction may be connected by one data line, and wherein a plurality of transistors constituting the dual subpixel may be selectively connected to a signal line extending through a region of the two white subpixels.

According to an embodiment of the present disclosure, the colored subpixel may include a red subpixel, a green subpixel, and a blue subpixel. According to an embodiment of the present disclosure, the same data voltage may be applied to two colored subpixels adjacent in the first direction.

According to an embodiment of the present disclosure, the display panel may connect two colored subpixels adjacent in the first direction to one data pad. According to an embodiment of the present disclosure, the timing controller may convert YCbCr image data of 4:2:0 format into image data for display.

According to an embodiment of the present disclosure, the white subpixel and the dual subpixel may include a light-emitting element, a driving transistor providing current to the light-emitting element, a switching transistor electrically connected between a gate node of the driving transistor and the data line, a sensing transistor electrically connected between a source node or a drain node of the driving transistor and a reference voltage line, and a storage capacitor electrically connected between the gate node of the driving transistor and the source node or the drain node of the driving transistor.

According to an embodiment of the present disclosure, in the sensing transistor included in the dual subpixel, a gate node thereof may be electrically connected to a first scan line extending through a first white subpixel corresponding to the dual subpixel, and in the switching transistor included in the dual subpixel, a gate node thereof may be electrically connected to a second scan line extending through a second white subpixel corresponding to the dual subpixel.

According to an embodiment of the present disclosure, in the driving transistor included in the dual subpixel, the drain node or the source node thereof may be electrically connected to a first driving voltage line extending to the first white subpixel or a second driving voltage line extending to the second white subpixel.

According to an embodiment of the present disclosure, in the sensing transistor included in the dual subpixel, a drain node or a source node thereof may be electrically connected to a first reference voltage line extending to the first white subpixel or a second reference voltage line extending to the second white subpixel.

According to an embodiment of the present disclosure, in the case that the pixel constitutes a WRGB dual pixel including the two white subpixels, a red-colored dual subpixel, a green-colored dual subpixel and a blue-colored dual subpixel, a driving voltage line supplying a driving voltage may extend in the second direction at a boundary between the WRGB dual pixels, and a reference voltage line supplying a reference voltage may extend in the second direction at a boundary between the red-colored dual subpixel and the green-colored dual subpixel.

According to an embodiment of the present disclosure, in the case that the pixel constitutes a RWGB dual pixel including a red-colored dual subpixel, the two white subpixels, a green-colored dual subpixel and a blue-colored dual subpixel, a driving voltage line extending in the second direction and supplying a driving voltage and a reference voltage line supplying a reference voltage may be alternately disposed on a boundary between the RWGB dual pixels.

According to an embodiment of the present disclosure, the dual subpixel may include a light-emitting element, a first driving transistor disposed at a position corresponding to a first white subpixel and providing current to the light-emitting element, a first switching transistor disposed at a position corresponding to the first white subpixel and electrically connected between a gate node of the first driving transistor and the data line, a first sensing transistor disposed at a position corresponding to the first white subpixel and electrically connected between a source node or a drain node of the first driving transistor and a reference voltage line, a first storage capacitor disposed at a position corresponding to the first white subpixel and electrically connected between a gate node of the first driving transistor and a source node or a drain node of the first driving transistor, a second driving transistor disposed at a position corresponding to a second white subpixel and providing current to the light-emitting element, a second switching transistor disposed at a position corresponding to the second white subpixel and electrically connected between a gate node of the second driving transistor and the data line, a second sensing transistor disposed at a position corresponding to the second white subpixel and electrically connected between a source node or a drain node of the second driving transistor and a reference voltage line, and a second storage capacitor disposed at a position corresponding to the second white subpixel and electrically connected between a gate node of the second driving transistor and a source node or a drain node of the second driving transistor.

In another aspect, embodiments of the present disclosure may provide a display panel including a plurality of pixels including a white subpixel and a colored subpixels, and arranged in a matrix form, and a data pad connecting two adjacent colored subpixels corresponding to the same color in a first direction, wherein luminance data may be applied to the white subpixel, and the colored subpixel may include dual subpixel corresponding to the size of two white subpixels arranged in a second direction, and wherein a plurality of transistors constituting the dual subpixel may be selectively connected to a signal line extending through a region of the two white subpixels.

According to embodiments of the present disclosure, it may be possible to provide a display device and a display panel capable of displaying YCbCr image data as WRGB image data. In addition, according to embodiments of the present disclosure, it may be possible to provide a display device and a display panel capable of displaying YCbCr image data as WRGB image data while simplifying the structure of a driving circuit.

In addition, according to embodiments of the present disclosure, it may be possible to provide a display device and a display panel capable of displaying YCbCr image data as WRGB image data by changing the structure of the display panel. In addition, according to embodiments of the present disclosure, it may be possible to provide a display device and a display panel capable of improving the aperture ratio by effectively arranging circuit elements and signal lines when displaying YCbCr image data as WRGB image data.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. A display device, comprising:

a display panel including a plurality of pixels arranged in a matrix, in which each pixel includes two white subpixels and three colored subpixels, and the subpixels are disposed in a region where a plurality of gate lines extending in a first direction and a plurality of data lines extending in a second direction intersect;

a gate driving circuit driving the plurality of gate lines;

a data driving circuit driving the plurality of data lines; and a timing controller for controlling the gate driving circuit and the data driving circuit, wherein luminance data is individually applied to each of the two white subpixels, and each of the three colored subpixels is a dual-sized subpixel corresponding to the size of the two white subpixels arranged in the second direction, wherein same colored subpixels located in adjacent two pixels in the first direction are connected by one data line, and wherein a plurality of transistors constituting the three colored subpixels are selectively connected to a signal line extending through a region of the two white subpixels.

2. The display device of claim 1, wherein the three colored subpixels include a red subpixel, a green subpixel, and a blue subpixel.

3. The display device of claim 1, wherein the same data voltage is applied to the same colored subpixels located in adjacent two pixels in the first direction.

4. The display device of claim 1, wherein the display panel connects the same colored subpixels located in adjacent two pixels in the first direction to one data pad.

5. The display device of claim 1, wherein the timing controller converts YCbCr image data of 4:2:0 format into image data for display.

6. The display device of claim 1, wherein each of the two white subpixels and the three colored subpixels comprises:

a light emitting element;

a driving transistor providing current to the light emitting element;

a switching transistor electrically connected between a gate node of the driving transistor and the data line;

a sensing transistor electrically connected between a source node or a drain node of the driving transistor and a reference voltage line supplying a reference voltage; and a storage capacitor electrically connected between the gate node of the driving transistor and the source node or the drain node of the driving transistor.

7. The display device of claim 6, wherein, in each sensing transistor included in each of the three colored subpixels, a gate node thereof is electrically connected to a first scan line extending through a first white subpixel, and in each switching transistor included in each of the three colored subpixels, a gate node thereof is electrically connected to a second scan line extending through a second white subpixel.

8. The display device of claim 7, wherein, in each driving transistor included in each of the three colored subpixels, the drain node or the source node thereof is electrically connected to a first driving voltage line extending to the first white subpixel or a second driving voltage line extending to the second white subpixel.

9. The display device of claim 7, wherein, in each sensing transistor included in each of the three colored subpixels, a drain node or a source node thereof is electrically connected to the reference voltage line extending to the first white subpixel or the reference voltage line extending to the second white subpixel.

10. The display device of claim 1, wherein, in the case that each pixel constitutes a pixel including the two white subpixels, a red-colored subpixel, a green-colored subpixel and a blue-colored subpixel, a driving voltage line supplying a driving voltage extends in the second direction at a boundary between the pixels, and a reference voltage line supplying a reference voltage extends in the second direction at a boundary between the red-colored subpixel and the green-colored subpixel.

11. The display device of claim 1, wherein, in the case that each pixel constitutes a pixel including a red-colored subpixel, the two white subpixels, a green-colored subpixel and a blue-colored subpixel, a driving voltage line extending in the second direction and supplying a driving voltage and a reference voltage line supplying a reference voltage are alternately disposed on a boundary between the pixels.

12. The display device of claim 1, wherein each of the three colored subpixels comprises:

a light emitting element;

a first driving transistor disposed at a position corresponding to a first white subpixel and providing current to the light emitting element;

a first switching transistor disposed at a position corresponding to the first white subpixel and electrically connected between a gate node of the first driving transistor and the data line;

a first sensing transistor disposed at a position corresponding to the first white subpixel and electrically connected between a source node or a drain node of the first driving transistor and a reference voltage line supplying a reference voltage;

a first storage capacitor disposed at a position corresponding to the first white subpixel and electrically connected between a gate node of the first driving transistor and a source node or a drain node of the first driving transistor;

a second driving transistor disposed at a position corresponding to a second white subpixel and providing current to the light emitting element;

a second switching transistor disposed at a position corresponding to the second white subpixel and electrically connected between a gate node of the second driving transistor and the data line;

a second sensing transistor disposed at a position corresponding to the second white subpixel and electrically connected between a source node or a drain node of the second driving transistor and the reference voltage line; and a second storage capacitor disposed at a position corresponding to the second white subpixel and electrically connected between a gate node of the second driving transistor and a source node or a drain node of the second driving transistor.

13. A display panel, comprising:

a plurality of pixels arranged in a matrix, in which each pixel includes two white subpixels and three colored subpixels; and a data pad connecting two adjacent colored subpixels corresponding to the same color in a first direction, wherein luminance data is individually applied to each of the two white subpixels, and each of the three colored subpixels is a dual-sized subpixel corresponding to the size of the two white subpixels arranged in a second direction, and wherein a plurality of transistors constituting the three colored subpixels are selectively connected to a signal line extending through a region of the two white subpixels.

14. The display panel of claim 13, wherein each of the two white subpixels and the three colored subpixels comprises:

a light emitting element;

a driving transistor providing current to the light emitting element;

a switching transistor electrically connected between a gate node of the driving transistor and a data line;

a sensing transistor electrically connected between a source node or a drain node of the driving transistor and a reference voltage line supplying a reference voltage; and a storage capacitor electrically connected between the gate node of the driving transistor and the source node or the drain node of the driving transistor.

15. The display panel of claim 14, wherein, in each sensing transistor included in each of the three colored subpixels, a gate node thereof is electrically connected to a first scan line extending through a first white subpixel, and in each switching transistor included in each of the three colored subpixels, a gate node thereof is electrically connected to a second scan line extending through a second white subpixel.

16. The display panel of claim 15, wherein, in each driving transistor included in each of the three colored subpixels, the drain node or the source node thereof is electrically connected to a first driving voltage line extending to the first white subpixel or a second driving voltage line extending to the second white subpixel.

17. The display panel of claim 15, wherein, in each sensing transistor included in each of the three colored subpixels, a drain node or a source node thereof is electrically connected to the reference voltage line extending to the first white subpixel or the reference voltage line extending to the second white subpixel.

18. The display panel of claim 13, wherein, in the case that each pixel constitutes a pixel including the two white subpixels, a red-colored subpixel, a green-colored subpixel and a blue-colored subpixel, a driving voltage line supplying a driving voltage extends in the second direction at a boundary between the pixels, and a reference voltage line supplying a reference voltage extends in the second direction at a boundary between the red-colored subpixel and the green-colored subpixel.

19. The display panel of claim 13, wherein, in the case that each pixel constitutes a pixel including a red-colored subpixel, the two white subpixels, a green-colored subpixel and a blue-colored subpixel, a driving voltage line extending in the second direction and supplying a driving voltage and a reference voltage line supplying a reference voltage are alternately disposed on a boundary between the pixels.

20. The display panel of claim 13, wherein each of the three colored subpixels comprises:

a light emitting element;

a first driving transistor disposed at a position corresponding to a first white subpixel and providing current to the light emitting element;

a first switching transistor disposed at a position corresponding to the first white subpixel and electrically connected between a gate node of the first driving transistor and a data line;

a first sensing transistor disposed at a position corresponding to the first white subpixel and electrically connected between a source node or a drain node of the first driving transistor and a reference voltage line supplying a reference voltage;

a first storage capacitor disposed at a position corresponding to the first white subpixel and electrically connected between a gate node of the first driving transistor and a source node or a drain node of the first driving transistor;

a second driving transistor disposed at a position corresponding to a second white subpixel and providing current to the light emitting element;

a second switching transistor disposed at a position corresponding to the second white subpixel and electrically connected between a gate node of the second driving transistor and the data line;

a second sensing transistor disposed at a position corresponding to the second white subpixel and electrically connected between a source node or a drain node of the second driving transistor and the reference voltage line; and a second storage capacitor disposed at a position corresponding to the second white subpixel and electrically connected between a gate node of the second driving transistor and a source node or a drain node of the second driving transistor.

* * * * *